US009816166B2

(12) United States Patent
Na et al.

(10) Patent No.: US 9,816,166 B2
(45) Date of Patent: Nov. 14, 2017

(54) BULK NICKEL-PHOSPHORUS-BORON GLASSES BEARING MANGANESE

(71) Applicant: Glassimetal Technology, Inc., Pasadena, CA (US)

(72) Inventors: Jong Hyun Na, Pasadena, CA (US); Michael Floyd, Pasadena, CA (US); Marios D. Demetriou, West Hollywood, CA (US); William L. Johnson, San Marino, CA (US); Glenn Garrett, Pasadena, CA (US); Maximilien Launey, Pasadena, CA (US); Danielle Duggins, Garden Grove, CA (US)

(73) Assignee: Glassimetal Technology, Inc., Pasadena, CA (US)

( * ) Notice: Subject to any disclaimer, the term of this patent is extended or adjusted under 35 U.S.C. 154(b) by 291 days.

(21) Appl. No.: 14/191,127

(22) Filed: Feb. 26, 2014

(65) Prior Publication Data

US 2014/0238551 A1 Aug. 28, 2014

Related U.S. Application Data

(60) Provisional application No. 61/769,707, filed on Feb. 26, 2013.

(51) Int. Cl.

| | |
|---|---|
| ***C22C 45/04*** | (2006.01) |
| ***C22C 19/03*** | (2006.01) |
| ***C22C 1/00*** | (2006.01) |
| ***C22C 19/05*** | (2006.01) |

(52) U.S. Cl.
CPC ..... *C22C 45/04* (2013.01); *C22C 1/002* (2013.01); *C22C 19/03* (2013.01); *C22C 19/05* (2013.01)

(58) Field of Classification Search
None
See application file for complete search history.

(56) References Cited

U.S. PATENT DOCUMENTS

| | | | | |
|---|---|---|---|---|
| 3,856,513 | A | 12/1974 | Chen et al. | |
| 4,116,682 | A * | 9/1978 | Polk | C22C 45/008 148/304 |
| 4,126,284 | A | 11/1978 | Ichikawa et al. | |
| 4,144,058 | A | 3/1979 | Chen et al. | |

(Continued)

FOREIGN PATENT DOCUMENTS

| | | |
|---|---|---|
| CN | 1354274 | 6/2002 |
| CN | 1653200 | 8/2005 |

(Continued)

OTHER PUBLICATIONS

U.S. Appl. No. 14/501,779, filed Sep. 30, 2014, Na et al.

(Continued)

*Primary Examiner* — George Wyszomierski
(74) *Attorney, Agent, or Firm* — Polsinelli PC

(57) ABSTRACT

The disclosure is directed to Ni—P—B alloys bearing Mn and optionally Cr and Mo that are capable of forming a metallic glass, and more particularly metallic glass rods with diameters at least 1 mm and as large as 5 mm or larger. The disclosure is further directed to Ni—Mn—Cr—Mo—P—B alloys capable of demonstrating a good combination of glass forming ability, strength, toughness, bending ductility, and corrosion resistance.

19 Claims, 31 Drawing Sheets

(56) References Cited

U.S. PATENT DOCUMENTS

| | | | | |
|---|---|---|---|---|
| 4,152,144 | A | 5/1979 | Hasegawa et al. | |
| 4,385,932 | A | 5/1983 | Inomata et al. | |
| 4,582,536 | A | 4/1986 | Raybould | |
| 4,892,628 | A | 1/1990 | Guilinger | |
| 4,900,638 | A | 2/1990 | Emmerich | |
| 4,968,363 | A | 11/1990 | Hashimoto et al. | |
| 5,338,376 | A | 8/1994 | Liu et al. | |
| 5,429,725 | A | 7/1995 | Thorpe et al. | |
| 5,634,989 | A | 6/1997 | Hashimoto et al. | |
| 6,004,661 | A | 12/1999 | Sakai et al. | |
| 6,303,015 | B1 * | 10/2001 | Thorpe | C22C 45/04 204/291 |
| 6,325,868 | B1 | 12/2001 | Kim et al. | |
| 6,695,936 | B2 | 2/2004 | Johnson | |
| 8,052,923 | B2 | 11/2011 | Langlet | |
| 8,287,664 | B2 | 10/2012 | Brunner | |
| 2005/0263216 | A1 | 12/2005 | Chin et al. | |
| 2006/0213586 | A1 | 9/2006 | Kui | |
| 2007/0175545 | A1 * | 8/2007 | Urata | B22F 9/002 148/304 |
| 2009/0110955 | A1 | 4/2009 | Hartmann et al. | |
| 2012/0073710 | A1 | 3/2012 | Kim et al. | |
| 2012/0168037 | A1 | 7/2012 | Demetriou et al. | |
| 2013/0048152 | A1 | 2/2013 | Na et al. | |
| 2013/0263973 | A1 | 10/2013 | Kurahashi et al. | |
| 2014/0213384 | A1 | 7/2014 | Johnson et al. | |
| 2015/0047755 | A1 | 2/2015 | Na et al. | |
| 2015/0158126 | A1 | 6/2015 | Hartmann et al. | |
| 2015/0159242 | A1 | 6/2015 | Na et al. | |
| 2015/0176111 | A1 | 6/2015 | Na et al. | |
| 2015/0197837 | A9 | 7/2015 | Schramm et al. | |
| 2015/0240336 | A1 | 8/2015 | Na et al. | |

FOREIGN PATENT DOCUMENTS

| | | |
|---|---|---|
| DE | 3929222 | 3/1991 |
| DE | 10 2011 001 784 | 10/2012 |
| DE | 102011001783 | 10/2012 |
| EP | 0014335 | 8/1980 |
| EP | 0161393 | 11/1985 |
| EP | 0260706 | 3/1988 |
| EP | 1077272 | 2/2001 |
| EP | 1108796 | 6/2001 |
| EP | 1522602 | 4/2005 |
| JP | 54-76423 | 6/1979 |
| JP | S55-148752 | 11/1980 |
| JP | S57-13146 | 1/1982 |
| JP | 63-079930 | 4/1988 |
| JP | 63079931 | 4/1988 |
| JP | 63-277734 | 11/1988 |
| JP | 1-205062 | 8/1989 |
| JP | 08-269647 | 10/1996 |
| JP | 11-71659 | 3/1999 |
| JP | 2001-049407 | 2/2001 |
| JP | 2007-075867 | 3/2007 |
| WO | WO 2012/053570 | 4/2012 |
| WO | WO 2013/028790 | 2/2013 |

OTHER PUBLICATIONS

U.S. Appl. No. 14/824,733, filed Aug. 12, 2015, Na et al.
U.S. Appl. No. 14/797,878, filed Jul. 13, 2015, Na et al.
U.S. Appl. No. 14/029,719, filed Sep. 17, 2013, Na et al.
U.S. Appl. No. 14/048,894, filed Oct. 8, 2013, Na et al.
U.S. Appl. No. 14/067,521, filed Oct. 30, 2013, Na et al.
U.S. Appl. No. 14/077,830, filed Nov. 12, 2013, Na et al.
U.S. Appl. No. 14/149,035, filed Jan. 7, 2014, Na et al.

Habazaki et al., "Preparation of corrosion-resistant amorphous Ni—Cr—P—B bulk alloys containing molybdenum and tantalum," *Material Science and Engineering*, A304-306, 2001, pp. 696-700.

Zhang et al., "The Corrosion Behavior of Amorphous Ni—Cr—P Alloys in Concentrated Hydrofluoric Acid," *Corrosion Science*, vol. 33, No. 10, pp. 1519-1528, 1992.

Katagiri et al., "An attempt at preparation of corrosion-resistant bulk amorphous Ni—Cr—Ta—Mo—P—B alloys," *Corrosion Science*, vol. 43, No. 1, pp. 183-191, 2001.

Habazaki et al., "Corrosion behaviour of amorphous Ni—Cr—Nb—P—B bulk alloys in 6M HCI solution," *Material Science and Engineering*, A318, 2001, pp. 77-86.

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," *Materials Transactions*, vol. 48, No. 12, 2007, pp. 3176-3180.

Park T.G. et al., "Development of new Ni-based amorphous alloys containing no metalloid that have large undercooled liquid regions," *Scripta Materialia*, vol. 43, No. 2, 2000, pp. 109-114.

Mitsuhashi A. et al., "The corrosion behavior of amorphous nickel base alloys in a hot concentrated phosphoric acid," *Corrosion Science*, vol. 27, No. 9, 1987, pp. 957-970.

Kawashima A. et al., "Change in corrosion behavior of amorphous Ni—P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}Mo_{10}P_{20}$," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

* cited by examiner

BULK NICKEL-PHOSPHORUS-BORON GLASSES BEARING MANGANESE

CROSS-REFERENCE TO RELATED APPLICATIONS

The present application claims the benefit of U.S. Provisional Patent Application No. 61/769,707, entitled "Bulk Nickel-Phosphorus-Boron Glasses Bearing Chromium and Manganese", filed on Feb. 26, 2013, which is incorporated herein by reference in its entirety.

TECHNICAL FIELD

The present disclosure is relates to Ni—P—B alloys bearing Mn and optionally Cr and/or Mo, capable of forming a metallic glass, and in some aspects bulk metallic glass rods with diameters at least 1 mm and as large as 5 mm or larger.

BACKGROUND

European Patent Application 0161393 by O'Handley (1981), entitled "Low Magnetostriction Amorphous Metal Alloys", discloses Ni—Co-based alloys bearing, among other elements, Mn, Cr, P, B, that are capable of forming ultra-thin magnetic objects that are partially amorphous. Alloys disclosed therein that included Mn and Cr had to also include Co, as the O'Handley alloys were designed to create magnetic materials and Co is the only element included in the O'Handley alloys that would make the partially amorphous material magnetic. O'Handley's magnetic materials were only formed in the form of ultra-thin ribbons, splats, wires, etc., and required ultra-high cooling rates (on the order of $10^5$ K/s) to partially form the amorphous phase.

Bulk-glass forming Ni—Cr—Nb—P—B glasses capable of forming bulk metallic glass rods with diameters of 3 mm or greater have been disclosed in the following applications: U.S. patent application Ser. No. 13/592,095, entitled "Bulk Nickel-Based Chromium and Phosphorous Bearing Metallic Glasses", filed on Aug. 22, 2012, and U.S. Patent Application No. 61/720,015, entitled "Bulk Nickel-Based Chromium and Phosphorous Bearing Metallic Glasses with High Toughness", filed on Oct. 30, 2012, the disclosures of which are incorporated herein by reference in their entirety. In these applications, Ni-based compositions with a Cr content of between 5 and 9 atomic percent, Nb content of between 3 and 4 atomic percent, B content of about 3 atomic percent, and P content of about 16.5 atomic percent, are capable of forming bulk metallic glass rods with diameters as large as 11 mm or larger. In these earlier applications it was also disclosed that Mn can partially substitute Ni and/or Cr without significantly affecting glass-forming ability.

Bulk-glass forming Ni—Cr—Ta—P—B glasses capable of forming bulk metallic glass rods with diameters of 3 mm or greater have been disclosed in another recent application: U.S. Patent Application No. 61/726,740, entitled "Bulk Nickel-Phosphorus-Boron Glasses bearing Chromium and Tantalum", filed on Nov. 15, 2012, the disclosures of which is incorporated herein by reference in its entirety. In that earlier application, Ni-based compositions with a Cr content of between 6 and 10 atomic percent, Ta content of between 2.5 and 3 atomic percent, B content of about 3 atomic percent, and P content of about 16.5 atomic percent, were capable of forming bulk metallic glass rods with diameters as large as 7 mm or larger. In this earlier application it was also disclosed that up to 2 atomic percent of Mn can be included in the composition as a replacement for either Ni or Cr without significantly affecting glass-forming ability.

U.S. Patent Application No. 61/847,955, entitled "Bulk Nickel-Phosphorus-Boron Glasses bearing Molybdenum and Niobium", filed on Oct. 8, 2013, the disclosure of which is incorporated herein by reference in its entirety, disclosed In another application, glass forming Ni—Mo—Nb—P—B alloys. Those alloys comprise Mo in the range of 1 to 5 atomic percent, Nb in the range of 3 to 5 atomic percent, P in the range of 16 to 17 atomic percent, and B in the range of 2.75 and 3.75 atomic percent. In this earlier application it was disclosed that an addition of Mn of up to 2 atomic percent may improve the glass-forming ability of those alloys.

The Ni—Cr—Nb—P—B and Ni—Cr—Ta—P—B bulk-glass forming compositions in earlier disclosures demonstrate good glass forming ability (GFA), high strength and hardness, adequately high toughness and corrosion resistance. These attributes, combined with the low cost and abundance of elements Ni, Cr, P, and B, point to a potential for widespread engineering applications. However, elements Nb and Ta are relatively expensive. Moreover, Nb and Ta are not widely abundant such that their supply is limited and not necessarily secured enough for ultra-high volume manufacturing. The present disclosure provides metallic glass forming alloys that substitute Nb or Ta for more widely abundant and less expensive element(s), and without considerably degrading the bulk-glass forming ability and mechanical and chemical properties demonstrated by the Nb and Ta bearing alloys.

BRIEF SUMMARY

The present disclosure is directed to Ni—P—B alloys bearing Mn and optionally Cr and Mo that are capable of forming a metallic glass, and in some aspects metallic glass rods with diameters of at least 1 mm, and/or as large as 5 mm, or larger. The present disclosure is also directed to metallic glasses formed of the alloys.

In one aspect, the disclosure is directed to an alloy or metallic glass represented by the following formula (subscripts denote atomic percentages):

$$Ni_{(100-a-b-c)}Mn_aX_bP_{c-d}B_d \quad (1)$$

where:

a is between 0.5 and 10 b is up to 15 c is between 14 and 24 d is between 1 and 8 wherein X can be Cr and/or Mo.

In various aspects, the critical rod diameter of the alloys is at least 1 mm.

In another embodiment b is at least 1, and the alloy also comprises Nb and or Ta at a combined atomic concentration of less than 1 percent.

In another embodiment X is Cr and b is at least 3, or X is Mo and b is at least 1, and the combined atomic concentration of Nb and Ta is less than 1 percent.

In another embodiment b=0, and the alloy also comprises Nb and or Ta at a combined atomic concentration of less than 0.5 percent.

In another embodiment, up to 1 atomic percent of P is substituted by Si.

In another embodiment, up to 50 atomic percent of Ni is substituted by Co.

In another embodiment, up to 30 atomic percent of Ni is substituted by Fe.

In another embodiment, up to 10 atomic percent of Ni is substituted by Cu.

In another embodiment, the alloy comprises Ge, V, Sn, W, Ru, Re, Pd, Pt, or combinations thereof at combined atomic concentration of up to 2 percent.

In another embodiment, b=0, a is at least 2 and up to 9.5, c is between 16.5 and 21.5, d is between 1 and 6.5.

In another embodiment, b=0, a is between 3 and 8, and wherein the critical rod diameter is at least 2 mm.

In another embodiment, b=0, a is between 6 and 7.5 and the critical rod diameter is at least 3 mm.

In another embodiment, b=0, c is between 17.25 and 20.75 and the critical rod diameter is at least 2 mm.

In another embodiment, b=0, c is between 18.5 and 20.25 and the critical rod diameter is at least 3 mm.

In another embodiment, b=0, c is between 18.75 and 19.75 and the critical rod diameter is at least 4 mm.

In another embodiment, b=0, d is between 1.75 and 5.75 and the critical rod diameter is at least 2 mm.

In another embodiment, b=0, d is between 2.5 and 3.75 and the critical rod diameter is at least 3 mm.

The disclosure is also directed to a metallic glass or alloy selected from $Ni_{78.5}Mn_2P_{16.5}B_3$, $Ni_{78}Mn_{2.5}P_{16.5}B_3$, $Ni_{77}Mn_{3.5}P_{16.5}B_3$, $Ni_{75.5}Mn_5P_{16.5}B_3$, $Ni_{74.5}Mn_6P_{16.5}B_3$, $Ni_{74}Mn_{6.5}P_{16.5}B_3$, $Ni_{73.5}Mn_7P_{16.5}B_3$, $Ni_{73}Mn_{7.5}P_{16.5}B_3$, $Ni_{72.5}Mn_8P_{16.5}B_3$, $Ni_{71.5}Mn_9P_{16.5}B_3$, $Ni_{73.5}Mn_7P_{18}B_{1.5}$, $Ni_{73.5}Mn_7P_{17.5}B_2$, $Ni_{73.5}Mn_7P_{17}B_{2.5}$, $Ni_{73.5}Mn_7P_{16}B_{3.5}$, $Ni_{73.5}Mn_7P_{15.5}B_4$, $Ni_{73.5}Mn_7P_{15}B_{4.5}$, $Ni_{73.5}Mn_7P_{14.5}B_5$, $Ni_{73.5}Mn_7P_{14}B_{5.5}$, $Ni_{73.5}Mn_7P_{13.5}B_6$, $Ni_{75.78}Mn_{7.22}P_{14.38}B_{2.62}$, $Ni_{75.33}Mn_{7.17}P_{14.81}B_{2.69}$, $Ni_{74.87}Mn_{7.13}P_{15.23}B_{2.77}$, $Ni_{74.41}Mn_{7.09}P_{15.65}B_{2.85}$, $Ni_{73.96}Mn_{7.04}P_{16.08}B_{2.92}$, $Ni_{73.73}Mn_{7.02}P_{16.29}B_{2.96}$, $Ni_{73.04}Mn_{6.96}P_{16.92}B_{3.08}$, $Ni_{72.59}Mn_{6.91}P_{17.35}B_{3.15}$, and $Ni_{72.13}Mn_{6.87}P_{17.77}B_{3.23}$.

In another aspect, the present disclosure is directed to metallic glasses, and alloys capable of forming metallic glasses where the parameter b in Eq. 1 is greater than 0.

In some aspects, the disclosure is directed to an alloy and/or a metallic glass represented by the following formula (subscripts denote atomic percent):

$$Ni_{(100-a-b1-b2-c-d)}Mn_aCr_{b1}Mo_{b2}P_cB_d \quad (2)$$

where:

a is between 1 and 5 b1 is between 4 and 11 b2 is up to 3 c is between 15 and 19 d is between 1 and 5.

In various embodiments, the critical rod diameter of the alloy is at least 1 mm.

In another embodiment, a is between 2.25 and 3.75, b1 is between 5 and 10, b2 is up to 2, c is between 15.75 to 18, d is between 1.5 and 4.5, and the critical rod diameter of the alloy is at least 2 mm.

In another embodiment, a is between 2.5 and 3.5, b1 is between 6 and 9, b2 is up to 1.5, c is between 16 to 17.75, d is between 2.25 and 3.75, and the critical rod diameter of the alloy is at least 3 mm.

In another embodiment, a is between 2.75 and 3.25, b1 is between 6 and 8, b2 is between 0.75 and 1.25, c is between 16 to 17.25, d is between 2.5 and 3.5, and the critical rod diameter of the alloy is at least 4 mm.

In another embodiment, the sum of c and d is between 18.5 and 20.5, and the critical rod diameter of the alloy is at least 2 mm.

In another embodiment, the sum of c and d is between 19 and 20, and the critical rod diameter of the alloy is at least 3 mm.

In yet another embodiment of any of the foregoing, up to 1 atomic percent of P is substituted by Si.

In yet another embodiment of any of the foregoing, up to 2 atomic percent of Cr is substituted by Fe, Co, W, Ru, Re, Cu, Pd, Pt, or a combination thereof.

In yet another embodiment, up to 2 atomic percent of Ni is substituted by Fe, Co, W, Ru, Re, Cu, Pd, Pt, or combinations thereof.

In yet another embodiment, the melt is fluxed with a reducing agent prior to rapid quenching.

In yet another embodiment, the temperature of the melt prior to quenching is at least 100° C. above the liquidus temperature of the alloy.

In yet another embodiment, the temperature of the melt prior to quenching is at least 1100° C.

In yet another embodiment, the stress intensity factor at crack initiation when measured on a 3 mm diameter rod containing a notch with length between 1 and 2 mm and root radius between 0.1 and 0.15 mm is at least 60 MPa $m^{1/2}$.

In yet another embodiment, a wire made of such metallic glass having a diameter of 1 mm can undergo macroscopic plastic deformation under bending load without fracturing catastrophically.

The disclosure is also directed to metallic glass compositions or alloy compositions $Ni_{69}Cr_{8.5}Mn_3P_{17.5}B_2$, $Ni_{69}Cr_{8.5}Mn_3P_{17}B_{2.5}$, $Ni_{69}Cr_{8.5}Mn_3P_{16.5}B_3$, $Ni_{69}Cr_{8.5}Mn_3P_{16}B_{3.5}$, $Ni_{69}Cr_{8.5}Mn_3P_{15.5}B_4$, $Ni_{69}Cr_9Mn_{2.5}P_{16.5}B_3$, $Ni_{69}Cr_{8.75}Mn_{2.75}P_{16.5}B_3$, $Ni_{69}Cr_{8.25}Mn_{3.25}P_{16.5}B_3$, $Ni_{69}Cr_8Mn_{3.5}P_{16.5}B_3$, $Ni_{72}Cr_{5.5}Mn_3P_{16.5}B_3$, $Ni_{71}Cr_{6.5}Mn_3P_{16.5}B_3$, $Ni_{70}Cr_{7.5}Mn_3P_{16.5}B_3$, $Ni_{68}Cr_{9.5}Mn_3P_{16.5}B_3$, $Ni_{69.5}Cr_{8.5}Mn_3P_{16}B_3$, $Ni_{69.5}Cr_8Mn_3P_{16.5}B_3$, $Ni_{68.5}Cr_{8.5}Mn_3P_{17}B_3$, $Ni_{68}Cr_{8.5}Mn_3P_{17.5}B_3$, $Ni_{71}Cr_{6.5}Mn_{3.5}P_{16.5}B_3$, $Ni_{70.25}Cr_7Mn_{3.25}P_{16.5}B_3$, $Ni_{69.83}Cr_5Mn_{3.17}P_{16.5}B_3$, $Ni_{69.42}Cr_8Mn_{3.08}P_{16.5}B_3$, $Ni_{69.6}Cr_8Mn_{2.9}P_{16.5}B_3$, $Ni_{68.5}Cr_{8.5}Mn_3P_{16.5}B_3Si_{0.5}$, $Ni_{69}Cr_{8.5}Mn_3P_{15.5}B_3Si_1$, $Ni_{69}Cr_8Mn_3Mo_{0.5}P_{16.5}B_3$, $Ni_{69}Cr_{7.5}Mn_3Mo_1P_{16.5}B_3$, $Ni_{69}Cr_7Mn_3Mo_{1.5}P_{16.5}B_3$, and $Ni_{69}Cr_{6.5}Mn_3Mo_2P_{16.5}B_3$.

The disclosure is further directed to a metallic glass having any of the above formulas and/or formed of any of the foregoing alloys.

Additional embodiments and features are set forth in part in the description that follows, and in part will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

DETAILED DESCRIPTION

Figure 1:
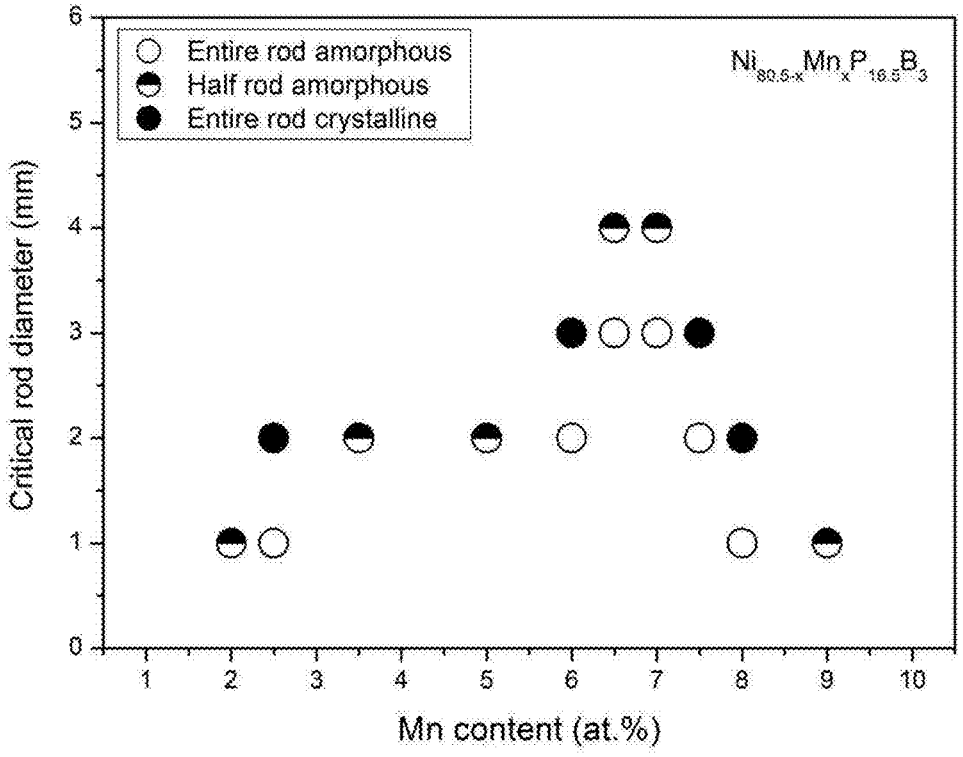
FIG. 1 provides a plot showing the effect of substituting Ni by Mn on the glass forming ability of $Ni_{80.5-x}Mn_xP_{16.5}B_3$, in accordance with embodiments of the present disclosure.

The present disclosure is directed to alloys, metallic glasses, and methods of making and using the same. In some aspects, the alloys are described as capable of forming metallic glasses having certain characteristics. It is intended, and will be understood by those skilled in the art, that the disclosure is also directed to metallic glasses formed of the disclosed alloys described herein.

Description of Alloy Compositions

In accordance with the provided disclosure and drawings, Ni—Mn—P—B alloys optionally containing Cr and Mo are capable of forming metallic glasses. In some aspects, the alloys have glass-forming ability comparable to the Ni—Cr—Nb—P—B, Ni—Cr—Ta—P—B, and Ni—Mo—Nb—P—B alloys. Specifically, in one aspect, the disclosure is directed to alloys and/or metallic glasses represented by the following formula (subscripts denote atomic percentages):

$$Ni_{(100-a-b-c)}Mn_aX_bP_{c-d}B_d \quad (1)$$

where:

a is between 0.5 and 10 b is up to 15 c is between 14 and 24 d is between 1 and 8 wherein X can be Cr and/or Mo.

In various aspects, the critical rod diameter of the alloy is at least 1 mm.

In another aspect, the alloys can be Ni-based alloys with a Mn content of between 0.5 and 10 atomic percent, a total metalloid content (i.e. the sum of P and B atomic concentrations) of between 14 and 24 atomic percent, and B content of between 1 and 6.5 atomic percent. In further aspects, the alloys have a Mn content of about 6 to 7.5 atomic percent, P content of about 16 to 16.5 atomic percent, and B content of about 3 atomic percent.

In the present disclosure, the glass-forming ability of each alloy can be quantified by the "critical rod diameter", defined as largest rod diameter in which the amorphous phase (i.e. the metallic glass) can be formed when processed by the method of water quenching a quartz tube with 0.5 mm thick wall containing a molten alloy.

In the present disclosure, the term "entirely free" of an element means not more than trace amounts of the element found in naturally occurring trace amounts.

The notch toughness, defined as the stress intensity factor at crack initiation $K_q$, is the measure of the material's ability to resist fracture in the presence of a notch. The notch toughness is a measure of the work required to propagate a crack originating from a notch. A high $K_q$ ensures that the material will be tough in the presence of defects.

The compressive yield strength, $\sigma_y$, is the measure of the material's ability to resist non-elastic yielding. The yield strength is the stress at which the material yields plastically. A high $\sigma_y$ ensures that the material will be strong.

Bending ductility is a measure of the material's ability to deform plastically and resist fracture in bending in the absence of a notch or a pre-crack. A high bending ductility ensures that the material will be ductile in a bending overload.

Sample metallic glasses 1-10 showing the effect of substituting Ni by Mn, according to the formula $Ni_{80.5-x}Mn_xP_{16.5}B_3$, are presented in Table 1 and FIG. 1. As shown in Table 1, when the Mn atomic concentration x is between 1.5 and 9.5 percent, the critical rod diameter is at least 1 mm. When the Mn atomic concentration x is at between 6.25 and 7.25 percent, the critical rode diameter is at least 4 mm.

Figure 2:
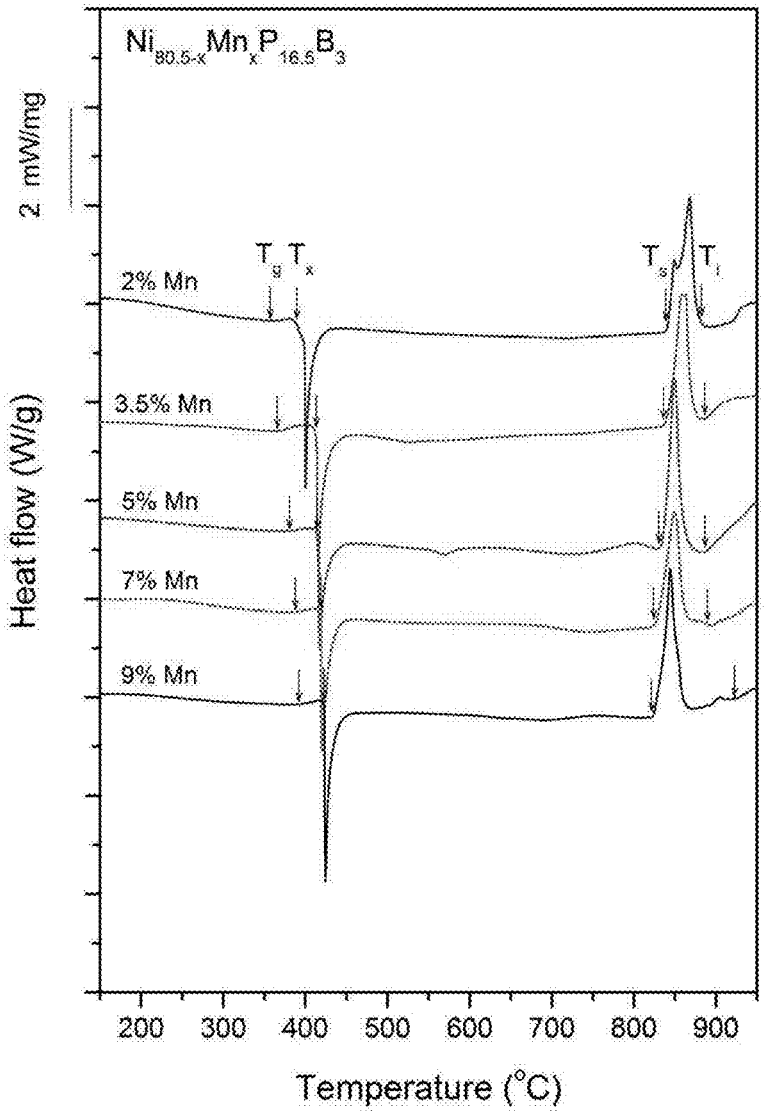
FIG. 2 provides a plot showing calorimetry scans for sample metallic glasses $Ni_{80.5-x}Mn_xP_{16.5}B_3$. Arrows from left to right designate the glass-transition, crystallization, solidus, and liquidus temperatures, respectively, in accordance with embodiments of the present disclosure.

Differential calorimetry scans for sample metallic glasses in which Ni is substituted by Mn are presented in FIG. 2. Arrows from left to right designate the glass-transition, crystallization, solidus, and liquidus temperatures, respectively.

TABLE 1

Sample metallic glasses demonstrating the effect of substituting Ni by Mn on the glass forming ability of the Ni—Mn—P—B alloys

| Example | Composition | Critical Rod Diameter [mm] |
|---|---|---|
| 1 | $Ni_{78.5}Mn_2P_{16.5}B_3$ | 1 |
| 2 | $Ni_{78}Mn_{2.5}P_{16.5}B_3$ | 1 |
| 3 | $Ni_{77}Mn_{3.5}P_{16.5}B_3$ | 2 |
| 4 | $Ni_{75.5}Mn_5P_{16.5}B_3$ | 2 |
| 5 | $Ni_{74.5}Mn_6P_{16.5}B_3$ | 2 |
| 6 | $Ni_{74}Mn_{6.5}P_{16.5}B_3$ | 4 |
| 7 | $Ni_{73.5}Mn_7P_{16.5}B_3$ | 4 |
| 8 | $Ni_{73}Mn_{7.5}P_{16.5}B_3$ | 2 |
| 9 | $Ni_{72.5}Mn_8P_{16.5}B_3$ | 1 |
| 10 | $Ni_{71.5}Mn_9P_{16.5}B_3$ | 1 |

Figure 3:
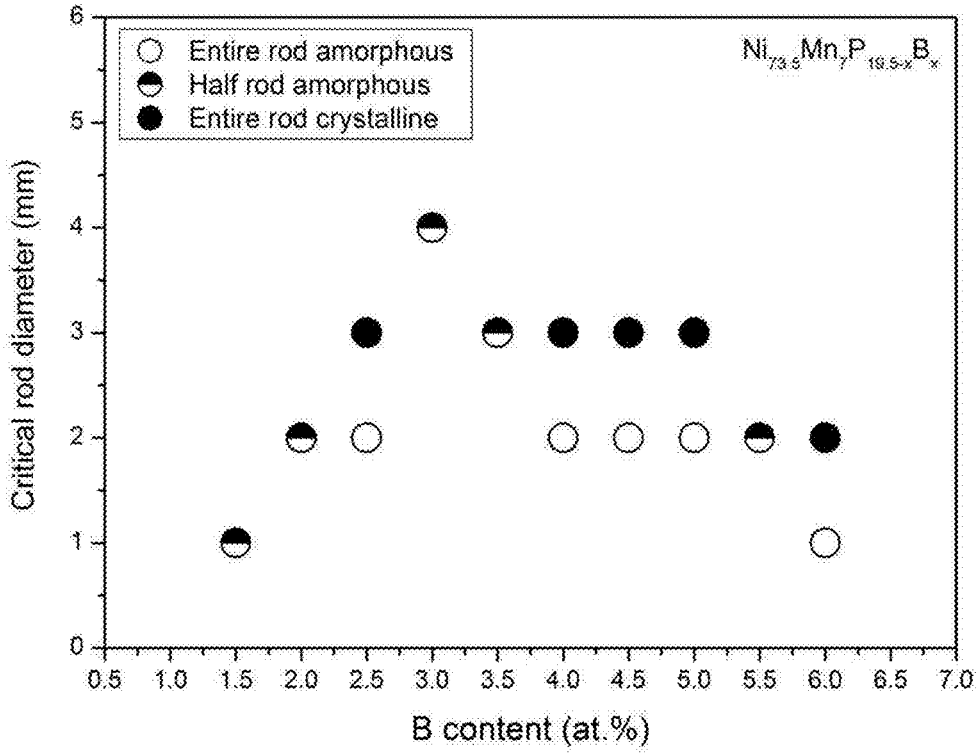
FIG. 3 illustrates the effect of substituting P by B on the glass forming ability of $Ni_{73.5}Mn_7P_{19.5-x}B_x$ alloys, in accordance with embodiments of the present disclosure.

Sample metallic glasses 7 and 11-19 showing the effect of substituting P by B, according to the formula $Ni_{73.5}Mn_7P_{19.5-x}B_x$, are presented in Table 2 and FIG. 3. As shown in Table 2, when the B atomic concentration x is between 1 and 6.5 percent, the critical rod diameter is at least 1 mm, while when the B atomic concentration x is between 2.5 and 3.5 percent, the critical rod diameter is at least 4 mm.

Figure 4:
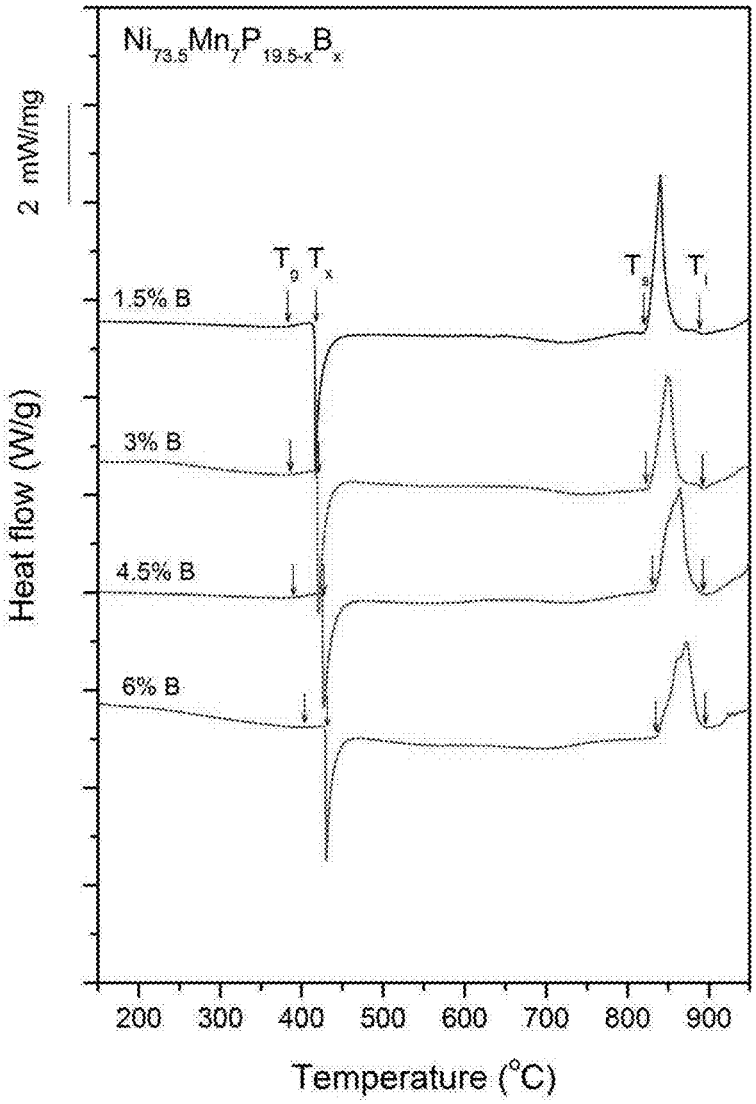
FIG. 4 depicts calorimetry scans for sample metallic glasses $Ni_{73.5}Mn_7P_{19.5-x}B_x$. Arrows from left to right designate the glass-transition, crystallization, solidus, and liquidus temperatures, respectively, in accordance with embodiments of the present disclosure.

Differential calorimetry scans for several sample metallic glasses in which P is substituted by B are presented in FIG. 4. Arrows from left to right designate the glass-transition, crystallization, solidus, and liquidus temperatures, respectively.

TABLE 2

Sample metallic glasses demonstrating the effect of substituting P by B on the glass forming ability of the Ni—Mn—P—B alloys

| Example | Composition | Critical Rod Diameter [mm] |
|---|---|---|
| 11 | $Ni_{73.5}Mn_7P_{18}B_{1.5}$ | 1 |
| 12 | $Ni_{73.5}Mn_7P_{17.5}B_2$ | 2 |
| 13 | $Ni_{73.5}Mn_7P_{17}B_{2.5}$ | 2 |
| 7 | $Ni_{73.5}Mn_7P_{16.5}B_3$ | 4 |
| 14 | $Ni_{73.5}Mn_7P_{16}B_{3.5}$ | 3 |
| 15 | $Ni_{73.5}Mn_7P_{15.5}B_4$ | 2 |
| 16 | $Ni_{73.5}Mn_7P_{15}B_{4.5}$ | 2 |
| 17 | $Ni_{73.5}Mn_7P_{14.5}B_5$ | 2 |
| 18 | $Ni_{73.5}Mn_7P_{14}B_{5.5}$ | 2 |
| 19 | $Ni_{73.5}Mn_7P_{13.5}B_6$ | 1 |

Figure 5:
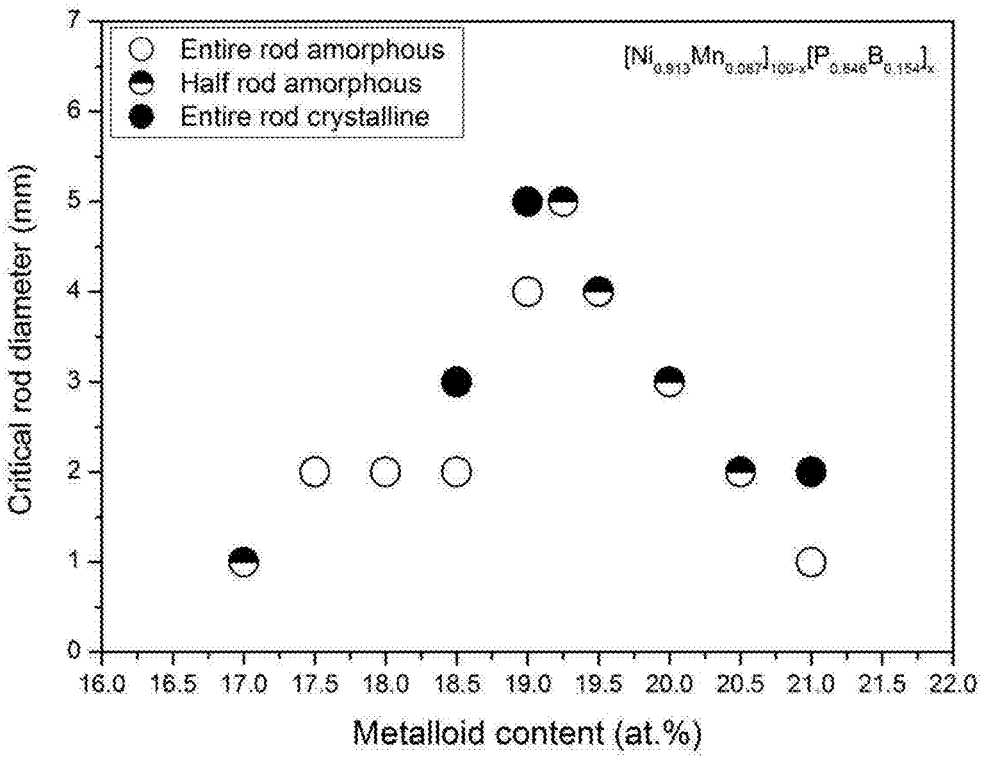
FIG. 5 illustrates the effect of varying the metal to metalloid ratio on the glass forming ability of $(Ni_{0.913}Mn_{0.087})_{100-x}(P_{0.846}B_{0.154})_x$ alloys, in accordance with embodiments of the present disclosure.

Sample metallic glasses 7 and 20-28 showing the effect of varying the metal to metalloid ratio, according to the formula $(Ni_{0.913}Mn_{0.087})_{100-x}(P_{0.846}B_{0.154})_x$, are presented in Table 3 and FIG. 5. As shown, when the metalloid atomic concentration is between 16.75 and 21.25 percent, the critical rod diameter is at least 1 mm, while when the metalloid atomic concentration x is between 18.75 and 19.5 percent, the critical rod diameter is at least 5 mm.

Figure 6:
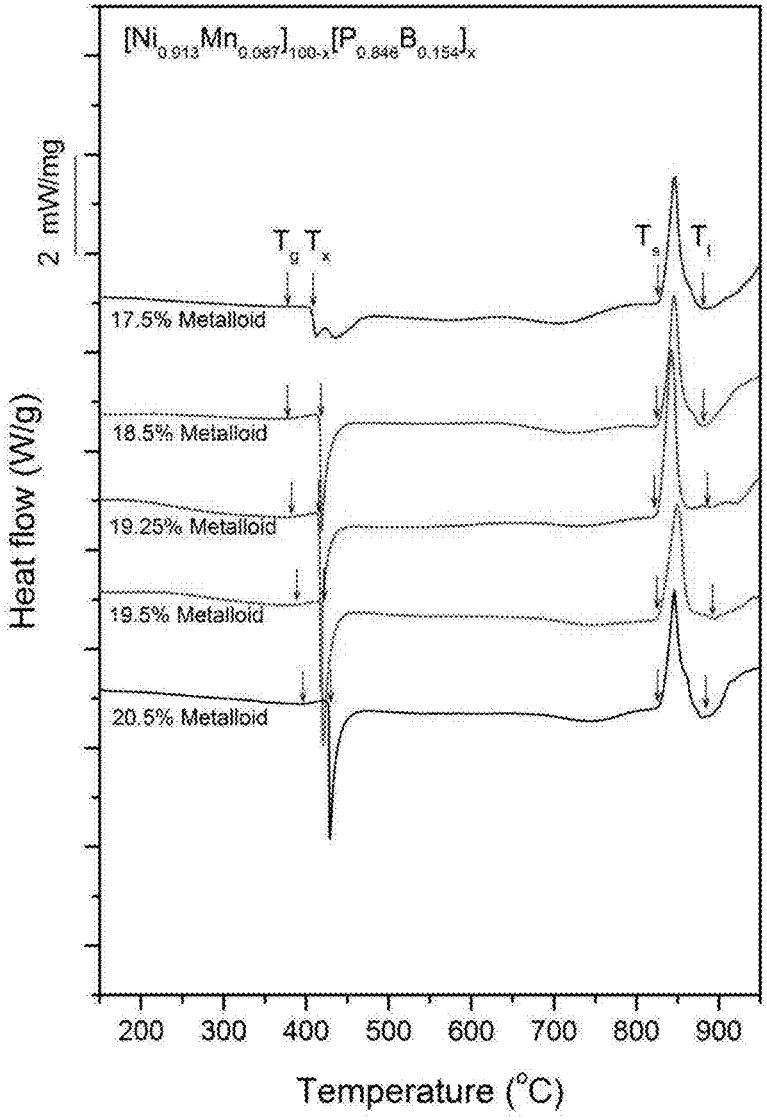
FIG. 6 depicts calorimetry scans for sample metallic glasses $(Ni_{0.913}Mn_{0.087})_{100-x}(P_{0.846}B_{0.154})_x$. Arrows from left to right designate the glass-transition, crystallization, solidus, and liquidus temperatures, respectively, in accordance with embodiments of the present disclosure.

Differential calorimetry scans for several sample metallic glasses in which the metal to metalloid ratio is varied are presented in FIG. 6. Arrows from left to right designate the glass-transition, crystallization, solidus, and liquidus temperatures, respectively.

TABLE 3

Sample metallic glasses demonstrating the effect of increasing the total metalloid concentration at the expense of metals on the glass forming ability of the Ni—Mn—P—B alloys

| Example | Composition | Critical Rod Diameter [mm] |
|---|---|---|
| 20 | $Ni_{75.78}Mn_{7.22}P_{14.38}B_{2.62}$ | 1 |
| 21 | $Ni_{75.33}Mn_{7.17}P_{14.81}B_{2.69}$ | 2 |
| 22 | $Ni_{74.87}Mn_{7.13}P_{15.23}B_{2.77}$ | 2 |
| 23 | $Ni_{74.41}Mn_{7.09}P_{15.65}B_{2.85}$ | 2 |
| 24 | $Ni_{73.96}Mn_{7.04}P_{16.08}B_{2.92}$ | 4 |
| 25 | $Ni_{73.73}Mn_{7.02}P_{16.29}B_{2.96}$ | 5 |
| 7 | $Ni_{73.5}Mn_7P_{16.5}B_3$ | 4 |
| 26 | $Ni_{73.04}Mn_{6.96}P_{16.92}B_{3.08}$ | 3 |
| 27 | $Ni_{72.59}Mn_{6.91}P_{17.35}B_{3.15}$ | 2 |
| 28 | $Ni_{72.13}Mn_{6.87}P_{17.77}B_{3.23}$ | 1 |

Figure 7:
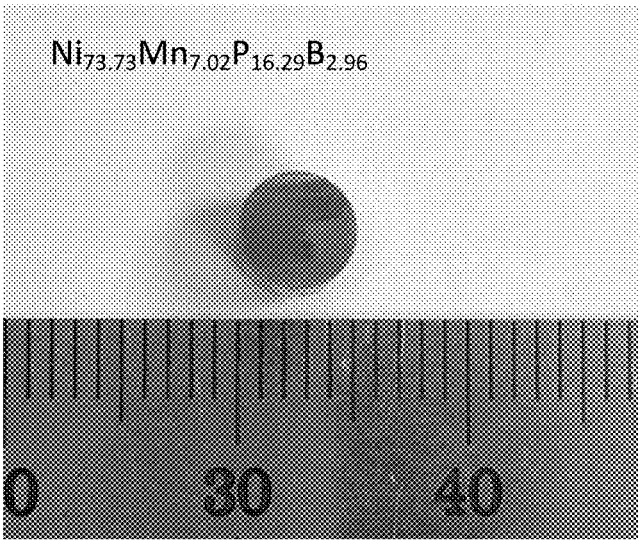
FIG. 7 provides an optical image of a 5 mm metallic glass rod of example alloy $Ni_{73.73}Mn_{7.02}P_{16.29}B_{2.96}$, in accordance with embodiments of the present disclosure.
Figure 8:
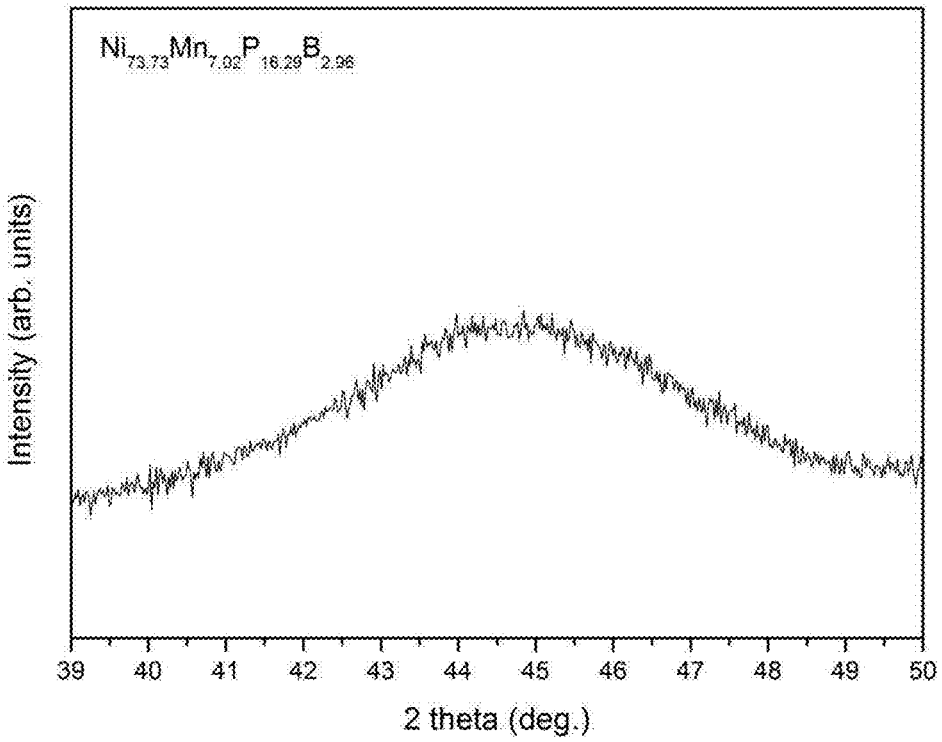
FIG. 8 provides an x-ray diffractogram verifying the amorphous structure of a 5 mm metallic glass rod of example alloy $Ni_{73.73}Mn_{7.02}P_{16.29}B_{2.96}$, in accordance with embodiments of the present disclosure.

An image of a 5 mm metallic glass rod of example alloy $Ni_{73.73}Mn_{7.02}P_{7.02}B_{2.96}$ is presented in FIG. 7. An x-ray diffractogram verifying the amorphous structure of a 5 mm metallic glass rod of example alloy $Ni_{73.73}Mn_{7.02}P_{16.29}B_{2.96}$ is shown in FIG. 8.

Figure 9:
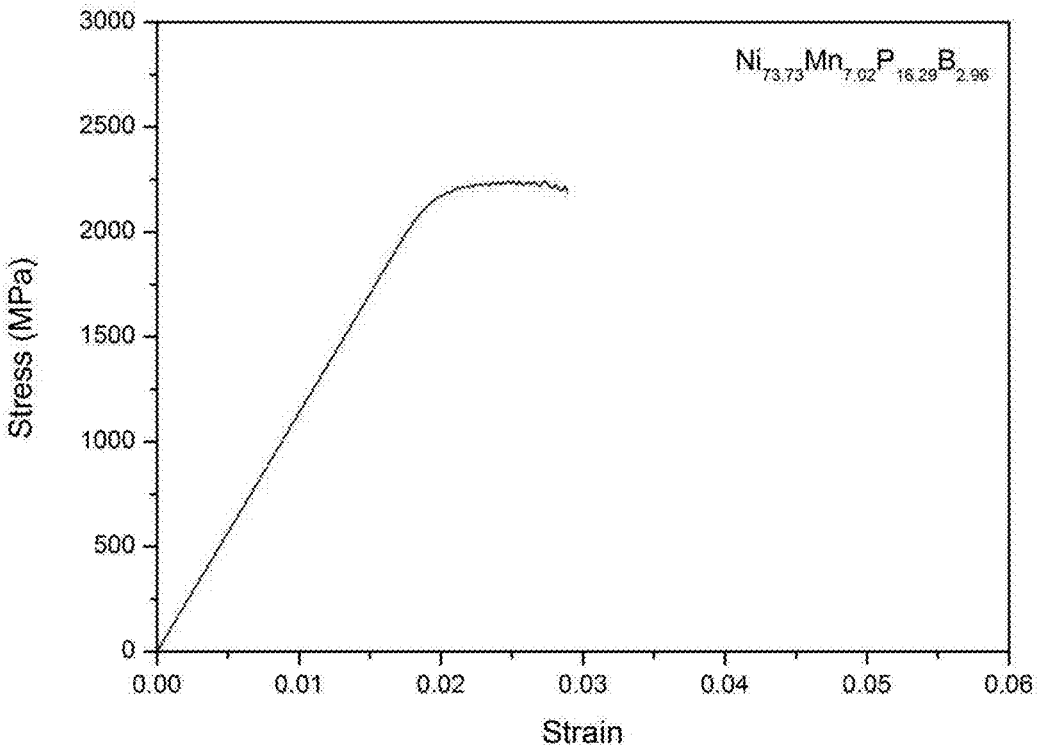
FIG. 9 provides a compressive stress-strain diagram of example metallic glass $Ni_{73.73}Mn_{7.02}P_{16.29}B_{2.96}$, in accordance with embodiments of the present disclosure.

The measured notch toughness and yield strength of sample metallic glass $Ni_{73.73}Mn_{7.02}P_{16.29}B_{2.96}$ are listed along with the critical rod diameter in Table 4. The stress-strain diagram for sample metallic glass $Ni_{73.73}Mn_{7.02}P_{16.29}B_{2.96}$ is presented in FIG. 9.

TABLE 4

Critical rod diameter, notch toughness, and yield strength of metallic glass $Ni_{73.73}Mn_{7.02}P_{16.29}B_{2.96}$

| Example | Composition | Critical Rod Diameter [mm] | Notch Toughness [MPa $m^{1/2}$] | Yield Strength [MPa] |
|---|---|---|---|---|
| 25 | $Ni_{73.73}Mn_{7.02}P_{16.29}B_{2.96}$ | 5 | 102.1 ± 1.1 | 2215 |

Figure 10:
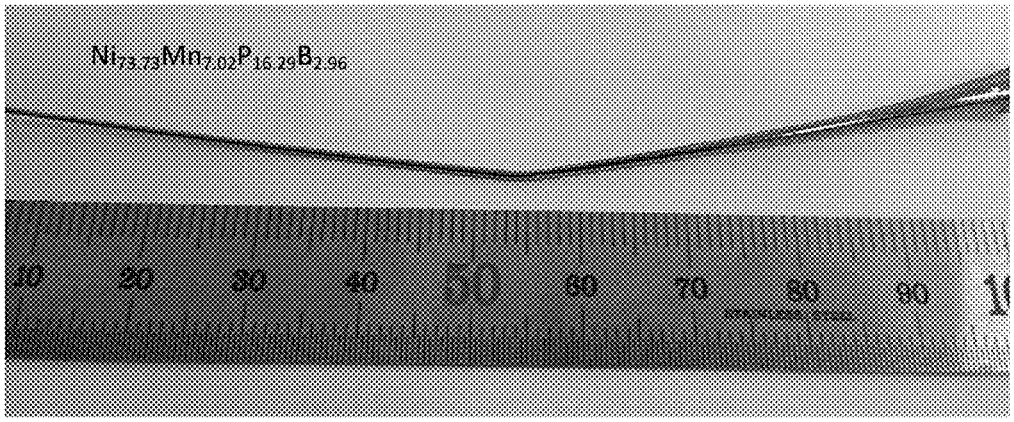
FIG. 10 provides an optical image of a plastically bent 1 mm metallic glass rod of example alloy $Ni_{73.73}Mn_{7.02}P_{16.29}B_{2.96}$, in accordance with embodiments of the present disclosure.

In various embodiments, the metallic glasses according to the disclosure demonstrate bending ductility. Specifically, under an applied bending load, the metallic glasses are capable of undergoing plastic bending in the absence of fracture for diameters up to at least 1 mm. Optical images of plastically bent metallic glass rods at 1-mm diameter section of sample metallic glass $Ni_{73.73}Mn_{7.02}P_{16.29}B_{2.96}$ is presented in FIG. 10.

In other aspects of the present disclosure, Ni—Mn—P—B alloys containing Cr and optionally a very small fraction of Mo, are capable of forming metallic glasses, and in some aspects bulk metallic glasses having glass-forming ability comparable to the Ni—Cr—Nb—P—B and Ni—Cr—Ta—P—B alloys. In some aspects, the disclosure is directed to a metallic glass comprising an alloy represented by the following formula (subscripts denote atomic percent):

$$Ni_{(100-a-b1-b2-c-d)}Mn_aCr_{b1}Mo_{b2}P_cB_d \quad (2)$$

where:
a is between 1 and 5
b1 is between 4 and 11
b2 is up to 3
c is between 15 and 19
d is between 1 and 5.

In certain variations, Ni-based compositions with a Mn content of about 3 atomic percent, Cr content of between 6 and 9 atomic percent, Mo content of up to 2 atomic percent, B content of about 3 atomic percent, and P content of about 16.5 atomic percent, are capable of forming bulk metallic glass rods with diameters of at least 1 mm, 2 mm, 3 mm, 4 mm, and as large as 5 mm or larger.

Figure 11:
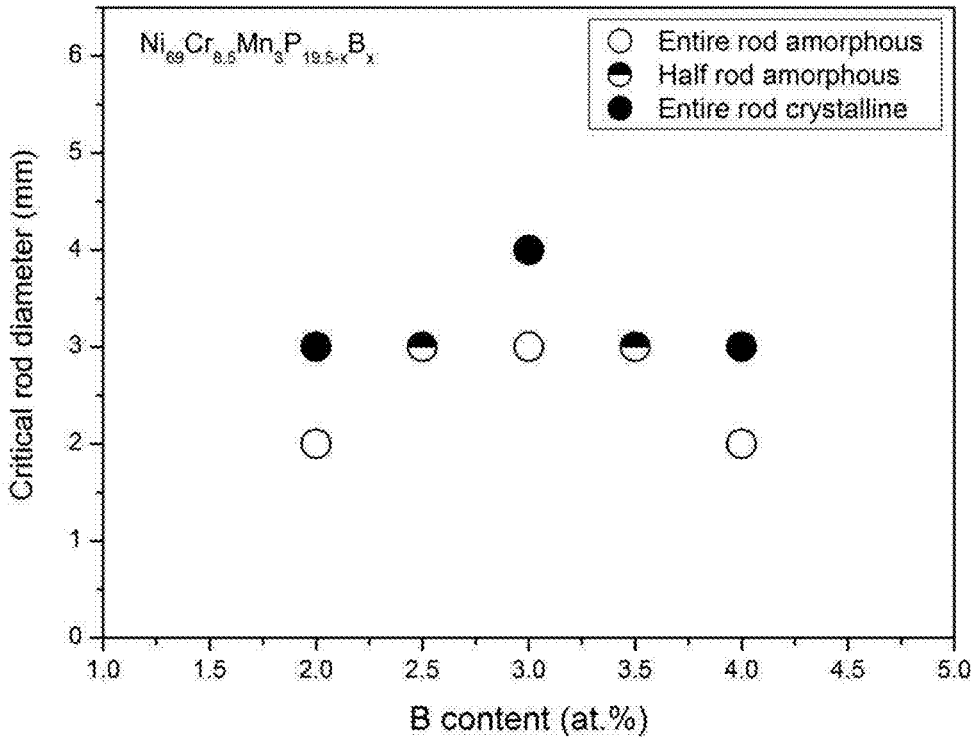
FIG. 11 illustrates the effect of substituting P by B on the glass forming ability of $Ni_{69}Cr_{8.5}Mn_3P_{19.5-x}B_x$, in accordance with embodiments of the present disclosure.

Sample metallic glasses 29-33 showing the effect of substituting P by B, according to the formula $Ni_{69}Cr_{8.5}Mn_3P_{19.5-x}B_x$, are presented in Table 5 and FIG. 11. As shown, when the B atomic concentration is between 2 and 4 percent, the critical rod diameter is at least 2 mm, while when the B atomic concentration is at about 3 percent, the critical rod diameter is at least 3-mm. It will be appreciated by those skilled in the art that when the concentration of B is reasonably outside the range demonstrated by the sample metallic glasses 29-33, for example, the concentration of B may be 1, or 5 atomic percent, metallic glasses can still be formed.

Figure 12:
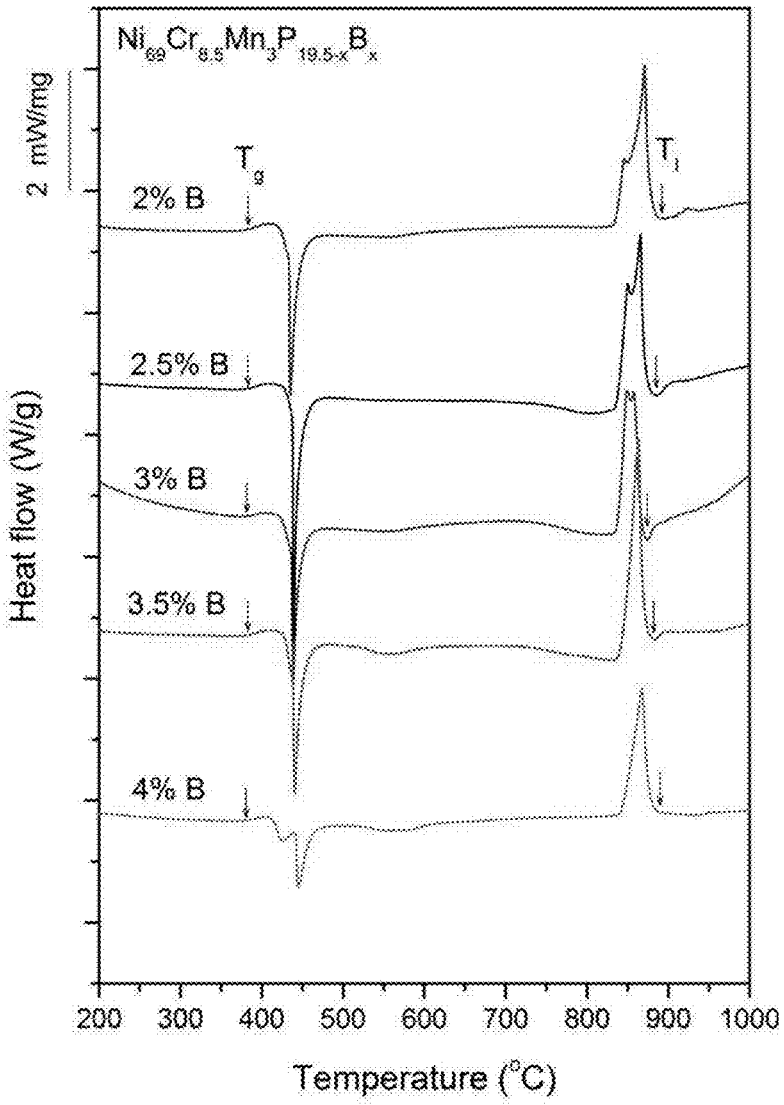
FIG. 12 provides a plot showing calorimetry scans for sample metallic glasses $Ni_{69}Cr_{8.5}Mn_3P_{19.5-x}B_x$. Arrows from left to right designate the glass-transition and liquidus temperatures, respectively, in accordance with embodiments of the present disclosure.

Differential calorimetry scans for sample metallic glasses in which P is substituted by B are presented in FIG. 12. Arrows from left to right designate the glass-transition, crystallization, solidus, and liquidus temperatures, respectively.

TABLE 5

Sample metallic glasses demonstrating the effect of increasing the B atomic concentration at the expense of P on the glass forming ability of the Ni—Cr—Mn—P—B alloy.

| Example | Composition | Critical Rod Diameter [mm] |
|---|---|---|
| 29 | $Ni_{69}Cr_{8.5}Mn_3P_{17.5}B_2$ | 2 |
| 30 | $Ni_{69}Cr_{8.5}Mn_3P_{17}B_{2.5}$ | 3 |
| 31 | $Ni_{69}Cr_{8.5}Mn_3P_{16.5}B_3$ | 3 |
| 32 | $Ni_{69}Cr_{8.5}Mn_3P_{16}B_{3.5}$ | 3 |
| 33 | $Ni_{69}Cr_{8.5}Mn_3P_{15.5}B_4$ | 2 |

Figure 13:
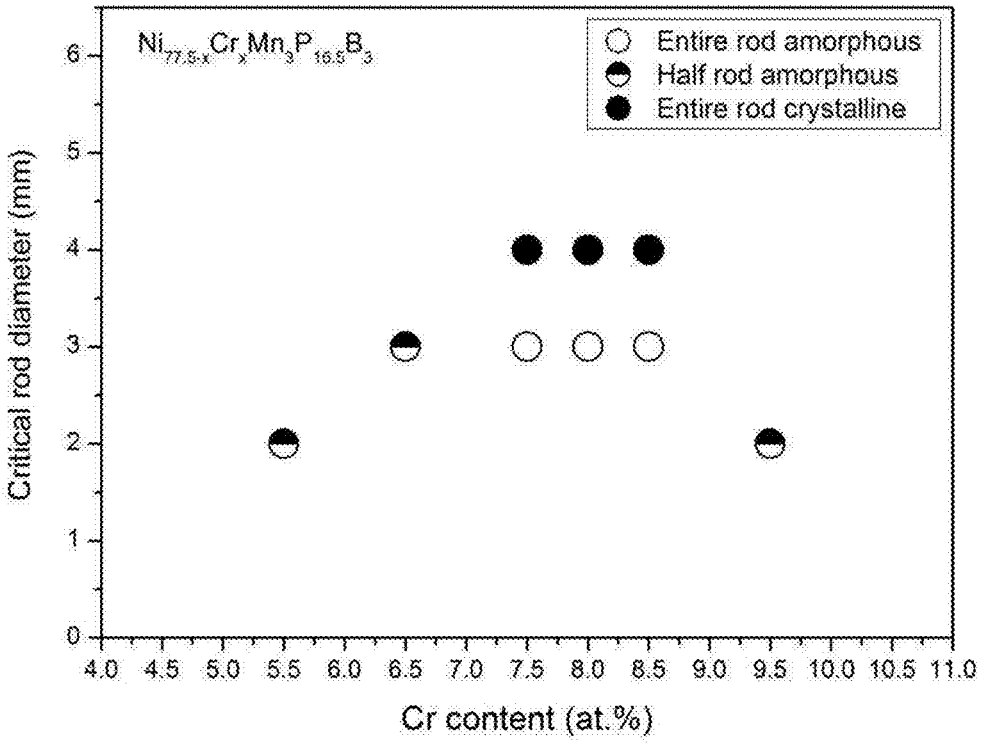
FIG. 13 illustrates the effect of substituting Ni by Cr on the glass forming ability of $Ni_{77.5-x}Cr_xMn_3P_{16.5}B_3$ alloys, in accordance with embodiments of the present disclosure.

Sample metallic glasses 31 and 34-38 showing the effect of substituting Ni by Cr, according to the formula $Ni_{77.5-x}Cr_xMn_3P_{16.5}B_3$, are presented in Table 6 and FIG. 13. As shown in Table 6, when the atomic concentration of Cr is between 5.5 and 9.5 percent, the critical rod diameter is at least 2 mm. When the atomic concentration of Cr is between 6.5 and 8.5 percent, the critical rod diameter is at least 3-mm. It will be appreciated by those skilled in the art that when the concentration of Cr is reasonably outside the range demonstrated by the sample metallic glasses, for example, the concentration of Cr may be 4, or 11 atomic percent, metallic glasses can still be formed.

Figure 14:
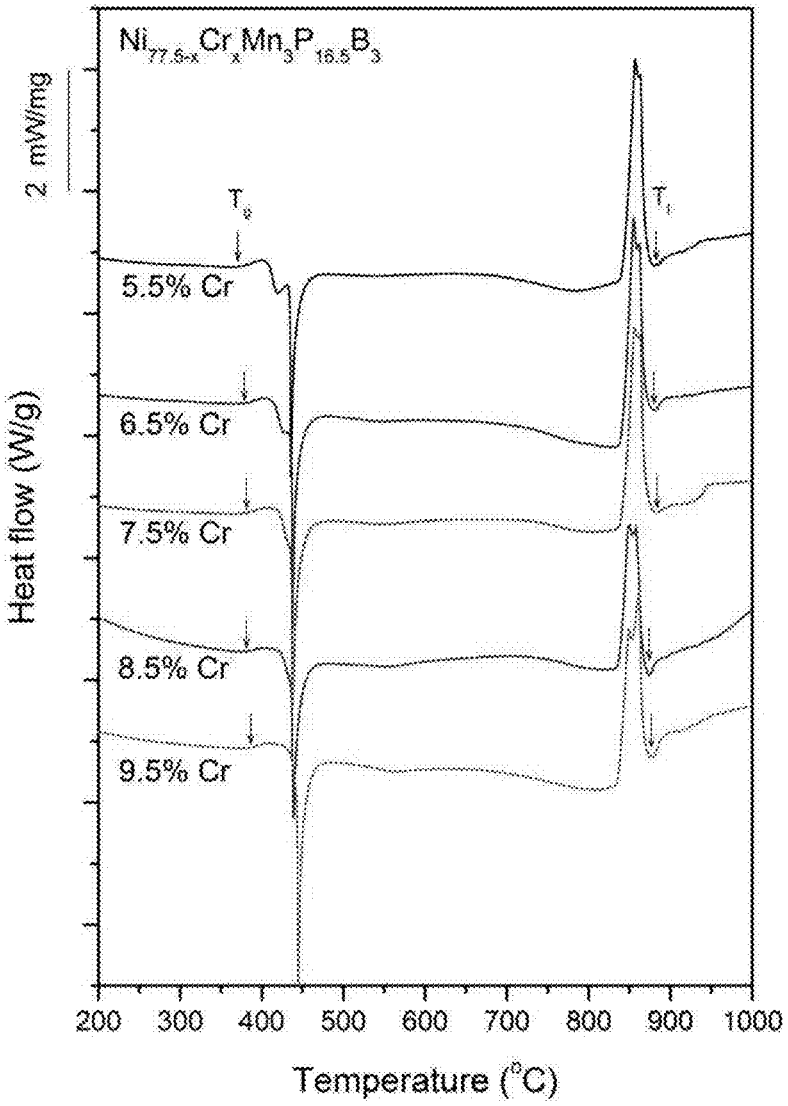
FIG. 14 provides calorimetry scans for sample metallic glasses $Ni_{77.5-x}Cr_xMn_3P_{16.5}B_3$. Arrows from left to right designate the glass-transition and liquidus temperatures, respectively, in accordance with embodiments of the present disclosure.

Differential calorimetry scans for several sample metallic glasses in which Ni is substituted by Cr are presented in FIG. 14. Arrows from left to right designate the glass-transition, crystallization, solidus, and liquidus temperatures, respectively.

TABLE 6

Sample metallic glasses demonstrating the effect of increasing the Cr atomic concentration at the expense of Ni on the glass forming ability of the Ni—Cr—Mn—P—B alloys

| Example | Composition | Critical Rod Diameter [mm] |
|---|---|---|
| 34 | $Ni_{72}Cr_{5.5}Mn_3P_{16.5}B_3$ | 2 |
| 35 | $Ni_{71}Cr_{6.5}Mn_3P_{16.5}B_3$ | 3 |
| 36 | $Ni_{70}Cr_{7.5}Mn_3P_{16.5}B_3$ | 3 |
| 37 | $Ni_{69.5}Cr_8Mn_3P_{16.5}B_3$ | 3 |
| 31 | $Ni_{69}Cr_{8.5}Mn_3P_{16.5}B_3$ | 3 |
| 38 | $Ni_{68}Cr_{9.5}Mn_3P_{16.5}B_3$ | 2 |

Figure 15:
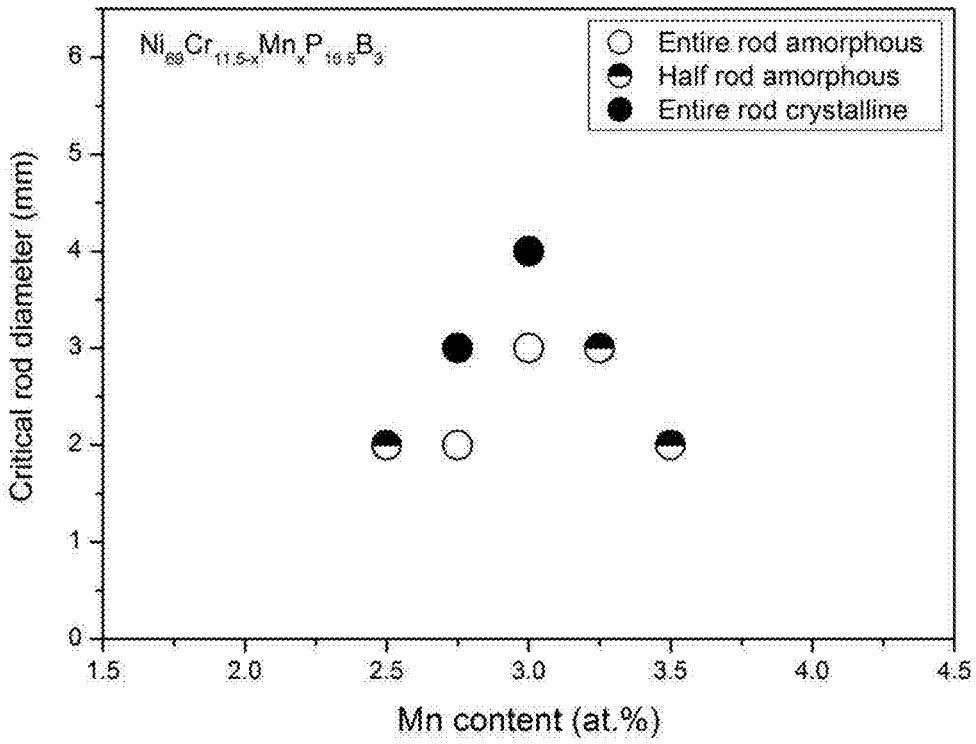
FIG. 15 illustrates the effect of substituting Cr by Mn on the glass forming ability of $Ni_{69}Cr_{11.5-x}Mn_xP_{16.5}B_3$ alloys, in accordance with embodiments of the present disclosure.

Sample metallic glasses 31, and 39-42 showing the effect of substituting Cr by Mn, according to the formula $Ni_{69}Cr_{11.5-x}Mn_xP_{16.5}B_3$, are presented in Table 7 and FIG. 15. As shown, when the Mn atomic concentration is between 2.5 and 3.5 percent, the critical rod diameter is at least 2 mm, while when the Mn atomic concentration is at about 3 percent the critical rod diameter is at least 3-mm. It will be appreciated by those skilled in the art that when the concentration of Mn is reasonably outside the range demonstrated by the sample metallic glasses 31 and 39-42, for example, the concentration of Mn may be 1, or 5 atomic percent, metallic glasses can still be formed.

Figure 16:
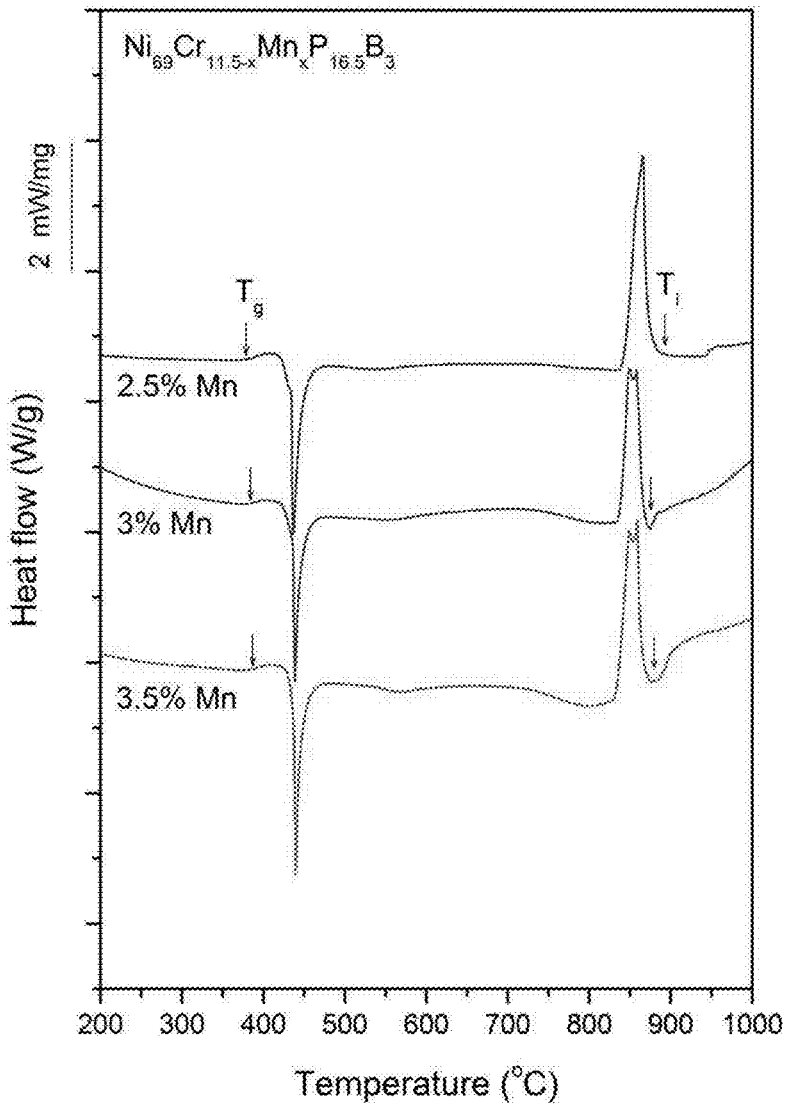
FIG. 16 provides calorimetry scans for sample metallic glasses $Ni_{69}Cr_{11.5-x}Mn_xP_{16.5}B_3$. Arrows from left to right designate the glass-transition and liquidus temperatures, respectively, in accordance with embodiments of the present disclosure.

Differential calorimetry scans for several sample metallic glasses in which Cr is substituted by Mn are presented in FIG. 16. Arrows from left to right designate the glass-transition, crystallization, solidus, and liquidus temperatures, respectively.

TABLE 7

Sample metallic glasses demonstrating the effect of increasing the Mn atomic concentration at the expense of Cr on the glass forming ability of the Ni—Cr—Mn—P—B alloys.

| Example | Composition | Critical Rod Diameter [mm] |
|---|---|---|
| 39 | $Ni_{69}Cr_9Mn_{2.5}P_{16.5}B_3$ | 2 |
| 40 | $Ni_{69}Cr_{8.75}Mn_{2.75}P_{16.5}B_3$ | 2 |
| 31 | $Ni_{69}Cr_{8.5}Mn_3P_{16.5}B_3$ | 3 |
| 41 | $Ni_{69}Cr_{8.25}Mn_{3.25}P_{16.5}B_3$ | 3 |
| 42 | $Ni_{69}Cr_8Mn_{3.5}P_{16.5}B_3$ | 2 |

Figure 17:
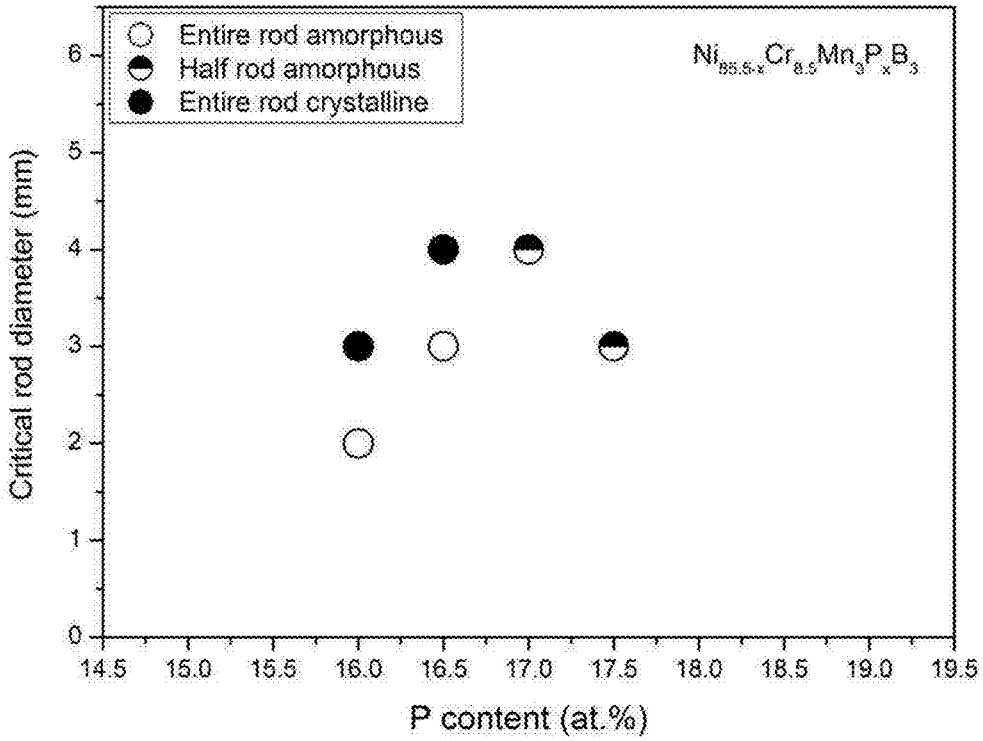
FIG. 17 illustrates the effect of substituting Ni by P on the glass forming ability of $Ni_{85.5-x}Cr_{8.5}Mn_3P_xB_3$ alloys, in accordance with embodiments of the present disclosure.

Sample metallic glasses 31 and 43-45 showing the effect of substituting Ni by P, according to the formula $Ni_{85.5-x}Cr_{8.5}Mn_3P_xB_3$, are presented in Table 8 and FIG. 17. As shown, when the P atomic concentration is between 16 and 18 percent, the critical rod diameter is at least 2 mm, while when the P atomic concentration is at about 17 percent, the critical rod diameter is at least 4 mm. It will be appreciated by those skilled in the art that when the concentration of P is reasonably outside the range demonstrated by the sample metallic glasses, for example, the atomic concentration of P may be 15, or 19 atomic percent, metallic glasses can still be formed.

Figure 18:
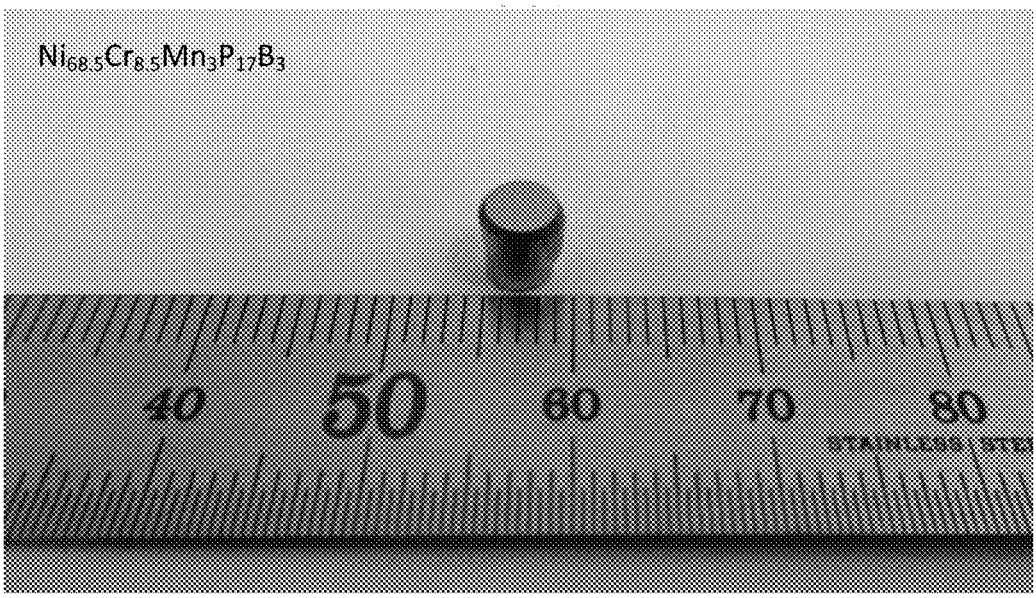
FIG. 18 provides an optical image of an amorphous 4 mm rod of example metallic glass $Ni_{68.5}Cr_{8.5}Mn_3P_{17}B_3$, in accordance with embodiments of the present disclosure.
Figure 19:
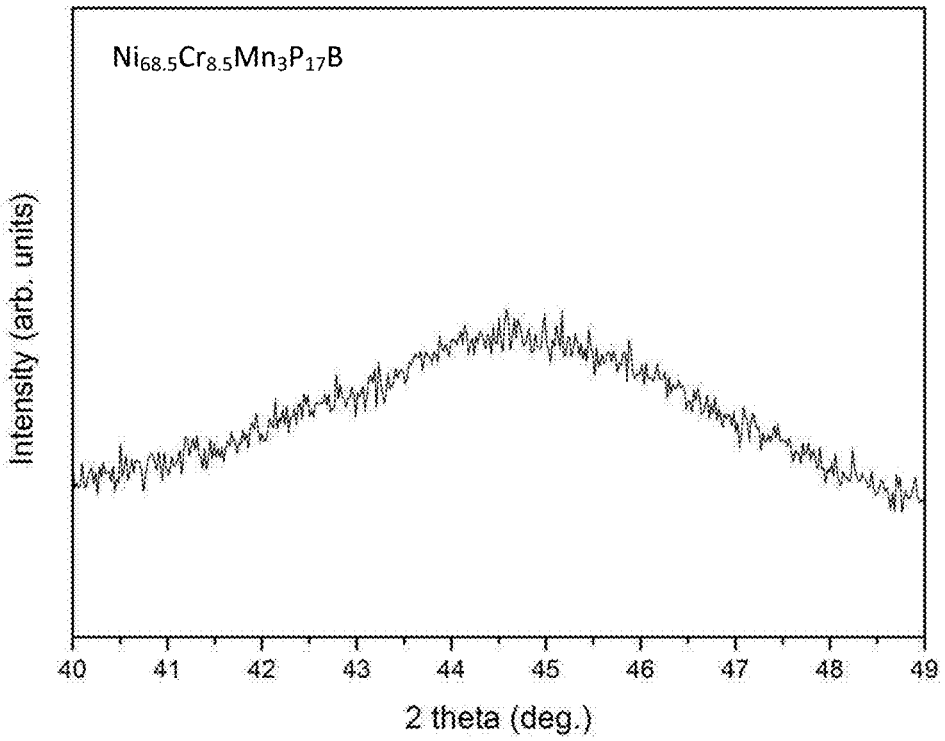
FIG. 19 provides an x-ray diffractogram verifying the amorphous structure of a 4 mm rod of example metallic glass $Ni_{68.5}Cr_{8.5}Mn_3P_{17}B_3$, in accordance with embodiments of the present disclosure.

An optical image of an amorphous 4 mm rod of example alloy $Ni_{68.5}Cr_{8.5}Mn_3P_{17}B_3$ is presented in FIG. 18. An x-ray diffractogram verifying the amorphous structure of a 4 mm rod of alloy $Ni_{68.5}Cr_{8.5}Mn_3P_{17}B_3$ is shown in FIG. 19.

Figure 20:
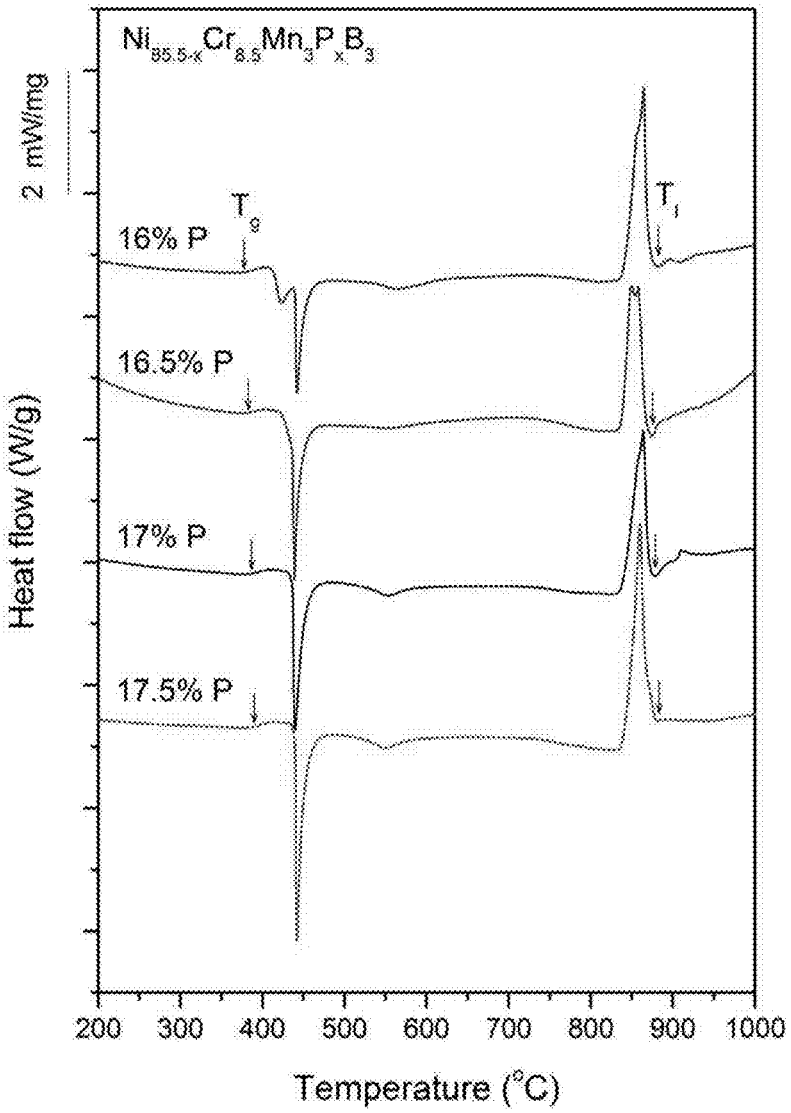
FIG. 20 provides calorimetry scans for sample metallic glasses $Ni_{85.5-x}Cr_{8.5}Mn_3P_xB_3$. Arrows from left to right designate the glass-transition and liquidus temperatures, respectively, in accordance with embodiments of the present disclosure.

Differential calorimetry scans for sample metallic glasses in which Ni is substituted by P are presented in FIG. 20. Arrows from left to right designate the glass-transition, crystallization, solidus, and liquidus temperatures, respectively.

TABLE 8

Sample metallic glasses demonstrating the effect of increasing the P atomic concentration at the expense of Ni on the glass forming ability of the Ni—Cr—Mn—P—B alloys.

| Example | Composition | Critical Rod Diameter [mm] |
|---|---|---|
| 43 | $Ni_{69.5}Cr_{8.5}Mn_3P_{16}B_3$ | 2 |
| 31 | $Ni_{69}Cr_{8.5}Mn_3P_{16.5}B_3$ | 3 |
| 44 | $Ni_{68.5}Cr_{8.5}Mn_3P_{17}B_3$ | 4 |
| 45 | $Ni_{68}Cr_{8.5}Mn_3P_{17.5}B_3$ | 3 |

Figure 21:
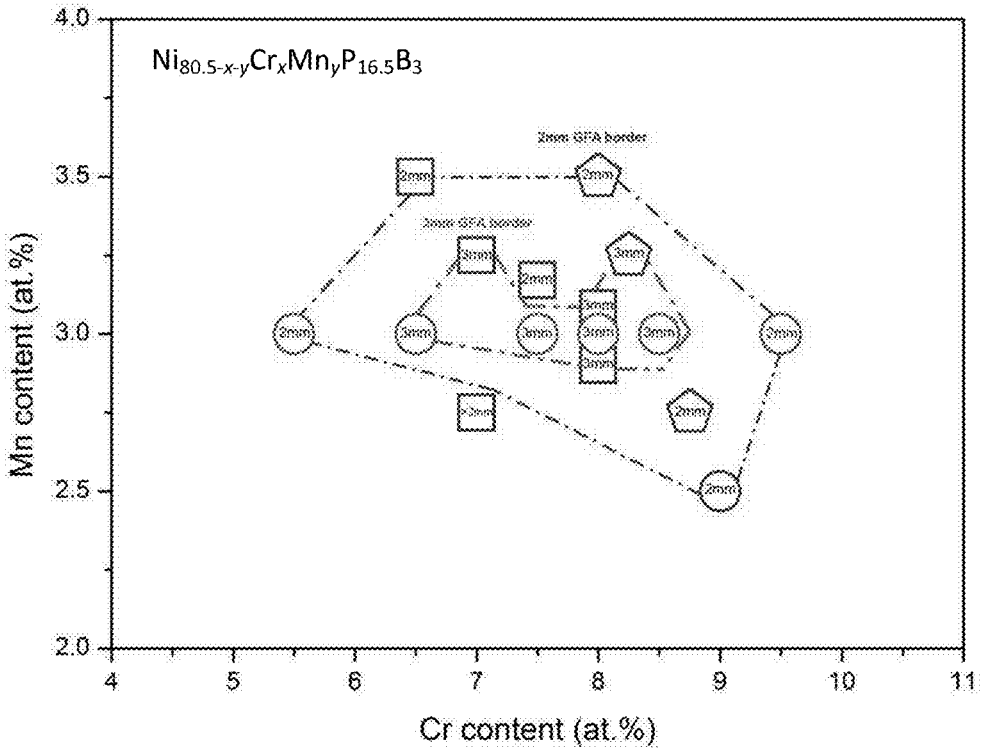
FIG. 21 illustrates the effect of substituting Ni by both Cr and Mn on the glass forming ability of $Ni_{80.5-x-y}Cr_xMn_yP_{16.5}B_3$ alloys, in accordance with embodiments of the present disclosure.

The critical rod diameters for sample metallic glasses showing the effect of substituting Ni by both Cr and Mn, according to the formula $Ni_{80.5-x-y}Cr_xMn_yP_{16.5}B_3$, are presented in a contour plot in FIG. 21. Certain metallic glasses 46-50 shown in FIG. 21 are not listed in Tables 1-4, but are presented in Table 9. As seen in the contour plot of FIG. 21, when x is between 6 and 8.5 and y between 2.8 and 3.3, the critical rod diameter is at least 3 mm. When x is between 5 and 10 and y between 2.5 and 3.5, the critical rod diameter is at least 2 mm.

TABLE 9

Sample metallic glasses demonstrating the effect of increasing the Cr and Mn atomic concentration at the expense of Ni on the glass forming ability of the Ni—Cr—Mn—P—B alloys.

| Example | Composition | Critical Rod Diameter [mm] |
|---|---|---|
| 46 | $Ni_{71}Cr_{6.5}Mn_{3.5}P_{16.5}B_3$ | 2 |
| 47 | $Ni_{70.25}Cr_7Mn_{3.25}P_{16.5}B_3$ | 3 |
| 48 | $Ni_{69.83}Cr_{7.5}Mn_{3.17}P_{16.5}B_3$ | 2 |
| 49 | $Ni_{69.42}Cr_8Mn_{3.08}P_{16.5}B_3$ | 3 |
| 50 | $Ni_{69.6}Cr_8Mn_{2.9}P_{16.5}B_3$ | 3 |

Figure 22:
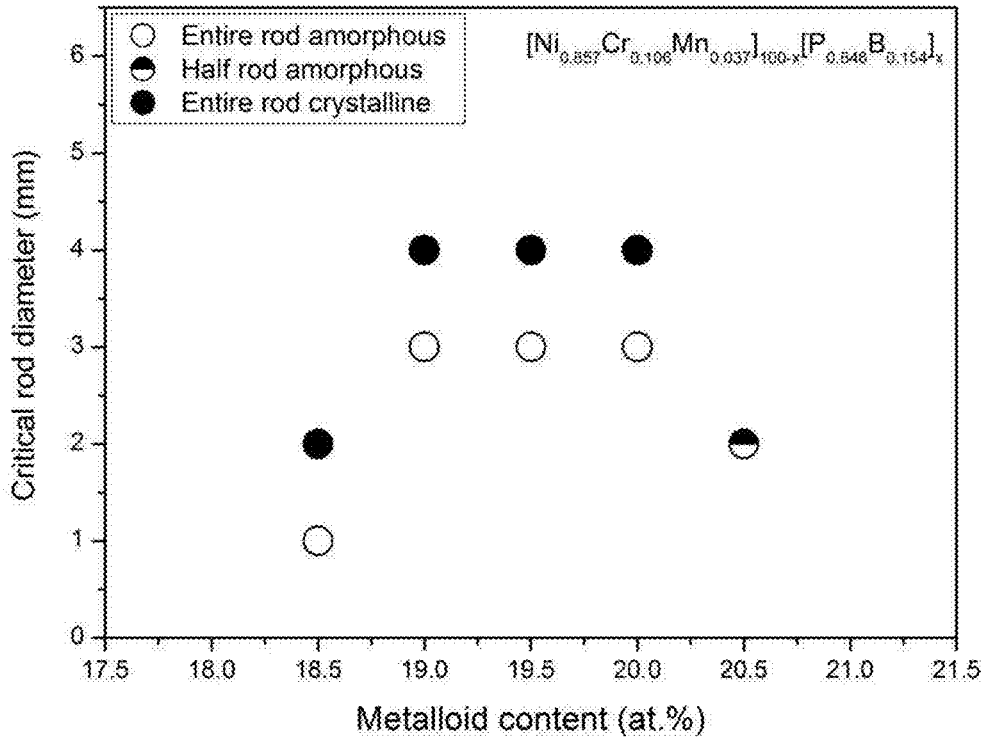
FIG. 22 illustrates the effect of varying the metal to metalloid ratio, according to the formula $(Ni_{0.857}Cr_{0.106}Mn_{0.037})_{100-x}(P_{0.846}B_{0.154})_x$, in accordance with embodiments of the present disclosure.

Sample metallic glasses 31 and 51-54 showing the effect of varying the metal to metalloid ratio, according to the formula $(Ni_{0.857}Cr_{0.106}Mn_{0.037})_{100-x}(P_{0.846}B_{0.154})_x$, are presented in Table 10 and FIG. 22. As shown in FIG. 22, when the metalloid atomic concentration x is between 19 and 20 percent, the critical rod diameter is at least 3 mm, while outside that range the glass forming ability decreases. It will be appreciated by those skilled in the art that when the concentration of metalloids is reasonably outside the range demonstrated by the sample metallic glasses 31 and 51-54, for example, the concentration of metalloids may be 17, or 22 atomic percent, metallic glasses can still be formed.

Figure 23:
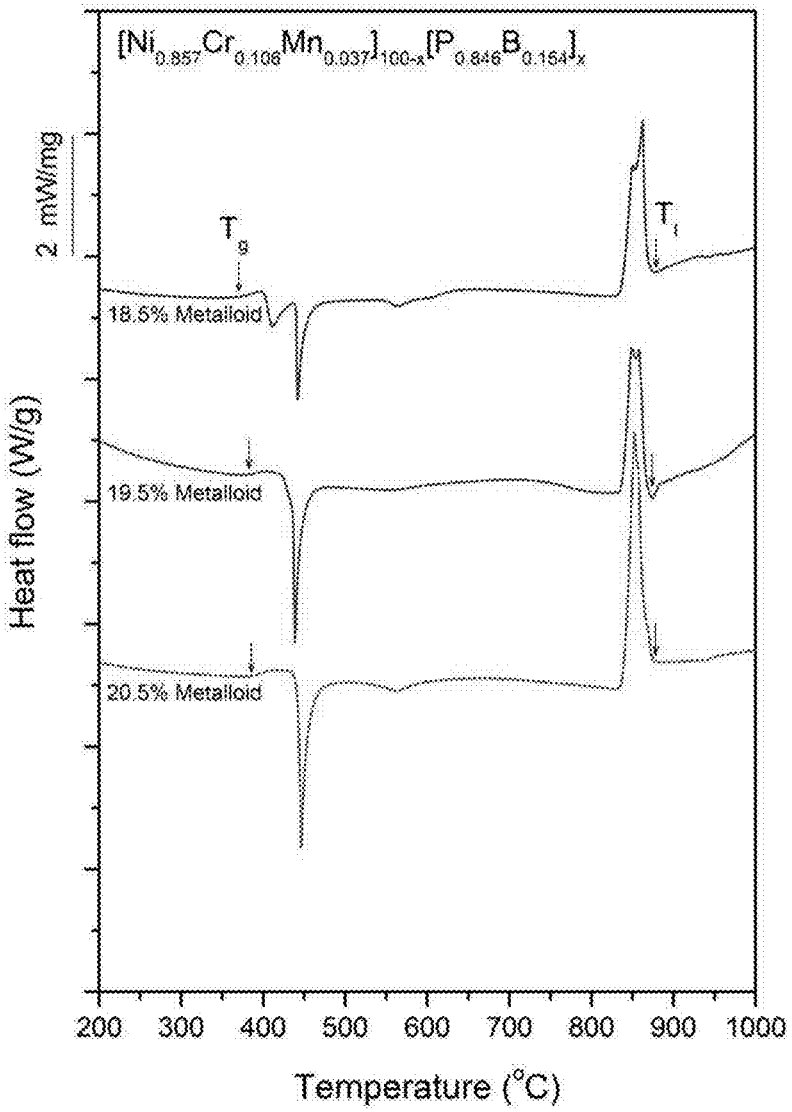
FIG. 23 provides calorimetry scans for sample metallic glasses $(Ni_{0.857}Cr_{0.106}Mn_{0.037})_{100-x}(P_{0.846}B_{0.154})_x$. Arrows from left to right designate the glass-transition and liquidus temperatures, respectively, in accordance with embodiments of the present disclosure.

Differential calorimetry scans for metallic glasses in which the metal to metalloid ratio is varied are presented in FIG. 23. Arrows from left to right designate the glass-transition, crystallization, solidus, and liquidus temperatures, respectively.

TABLE 10

Sample metallic glasses demonstrating the effect of increasing the total metalloid concentration at the expense of metals on the glass forming ability of the Ni—Cr—Mn—P—B alloys.

| Example | Composition | Critical Rod Diameter [mm] |
|---|---|---|
| 51 | $Ni_{69.86}Cr_{8.61}Mn_{3.04}P_{15.65}B_{2.85}$ | 1 |
| 52 | $Ni_{69.43}Cr_{8.55}Mn_{3.02}P_{16.08}B_{2.92}$ | 3 |
| 31 | $Ni_{69}Cr_{8.5}Mn_3P_{16.5}B_3$ | 3 |
| 53 | $Ni_{68.57}Cr_{8.45}Mn_{2.98}P_{16.92}B_{3.08}$ | 3 |
| 54 | $Ni_{68.14}Cr_{8.39}Mn_{2.96}P_{17.35}B_{3.15}$ | 2 |

Figure 24:
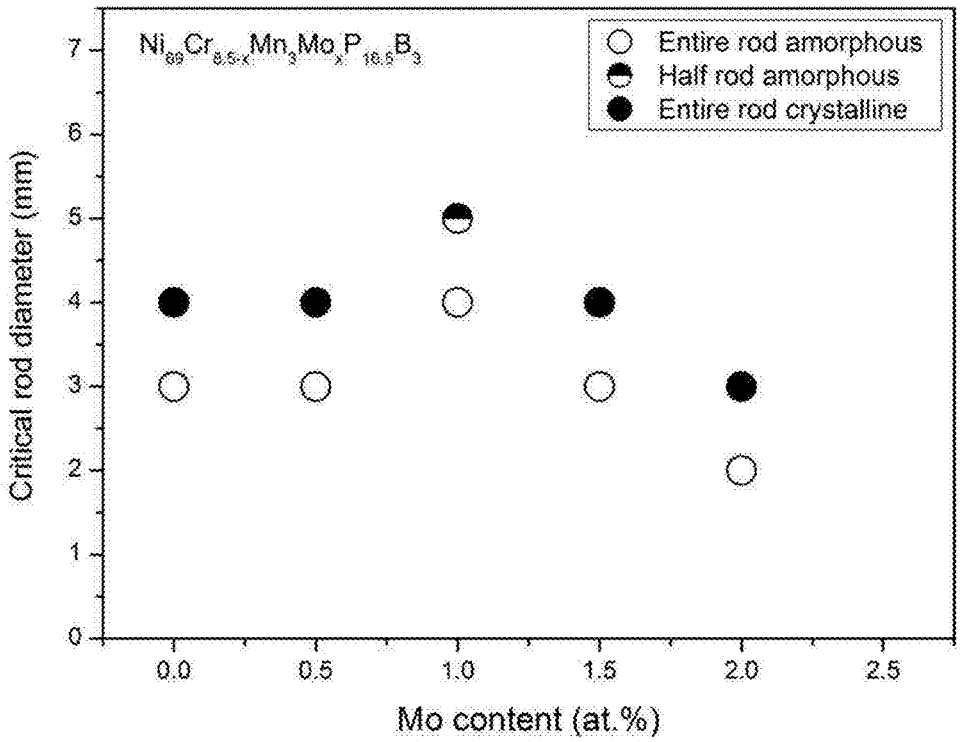
FIG. 24 illustrates the effect of substituting Cr by Mo according to the formula $Ni_{69}Cr_{8.5-x}Mn_3Mo_xP_{16.5}B_3$, in accordance with embodiments of the present disclosure.

Sample metallic glasses 31 and 55-58 showing the effect of substituting Cr by Mo, according to the formula $Ni_{69}Cr_{8.5-x}Mn_3Mo_xP_{16.5}B_3$, are presented in Table 11 and FIG. 24. As shown, when the Mo atomic concentration is about 1 percent, the critical rod diameter is at least 5 mm. When the Mo atomic concentration is about 2 percent or greater, the critical rod diameter of the metallic glass falls below the 3 mm threshold corresponding to the Mo free composition. It will be appreciated by those skilled in the art that when the concentration of Mo is reasonably outside the range demonstrated by the sample metallic glasses, for example, the concentration of Mo may be 3 atomic percent, metallic glasses can still be formed.

Figure 25:
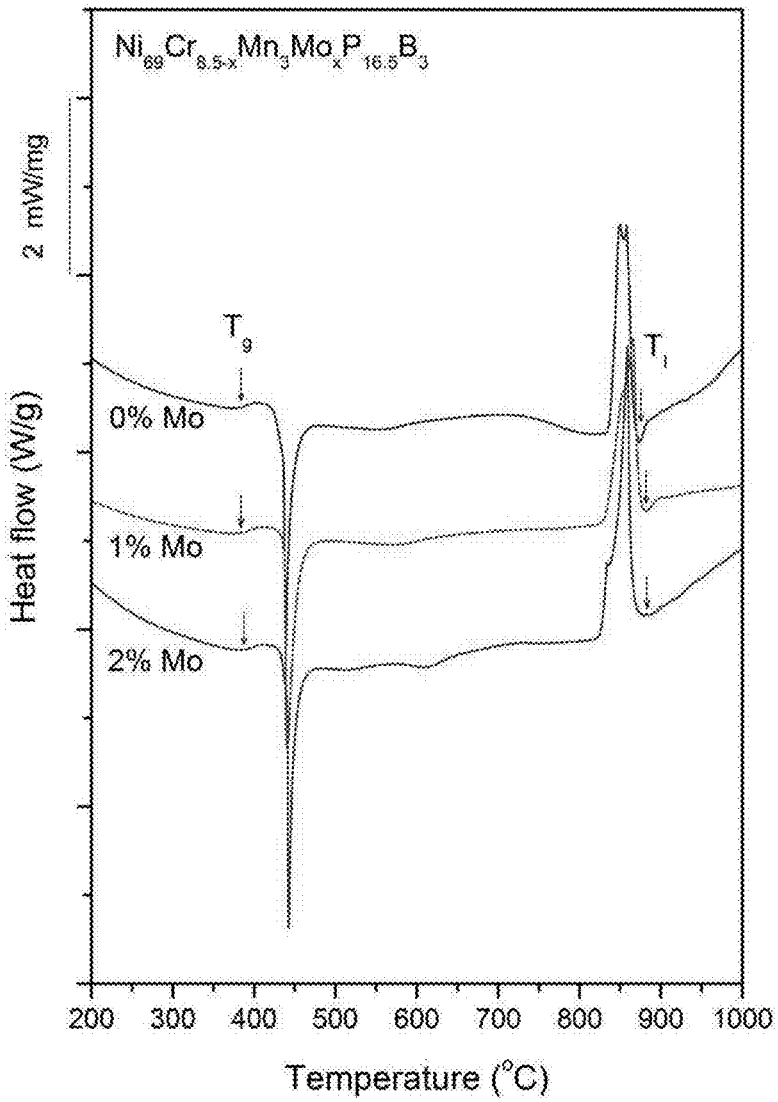
FIG. 25 provides calorimetry scans for sample metallic glasses $Ni_{69}Cr_{8.5-x}Mn_3Mo_xP_{16.5}B_3$. Arrows from left to right designate the glass-transition and liquidus temperatures, respectively, in accordance with embodiments of the present disclosure.

Differential calorimetry scans for example metallic glasses in which Cr is substituted by Mo are presented in FIG. 25. Arrows from left to right designate the glass-transition, crystallization, solidus, and liquidus temperatures, respectively.

Figure 26:
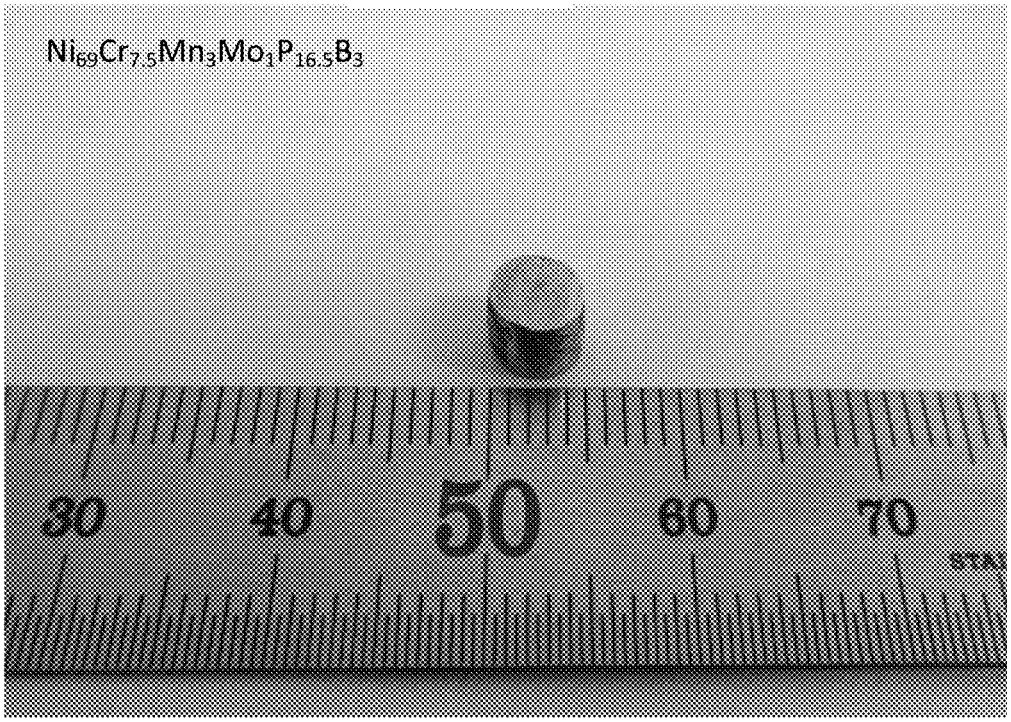
FIG. 26 provides an optical image of an amorphous 5 mm rod of example metallic glass $Ni_{69}Cr_{7.5}Mn_3Mo_1P_{16.5}B_3$, in accordance with embodiments of the present disclosure.
Figure 27:
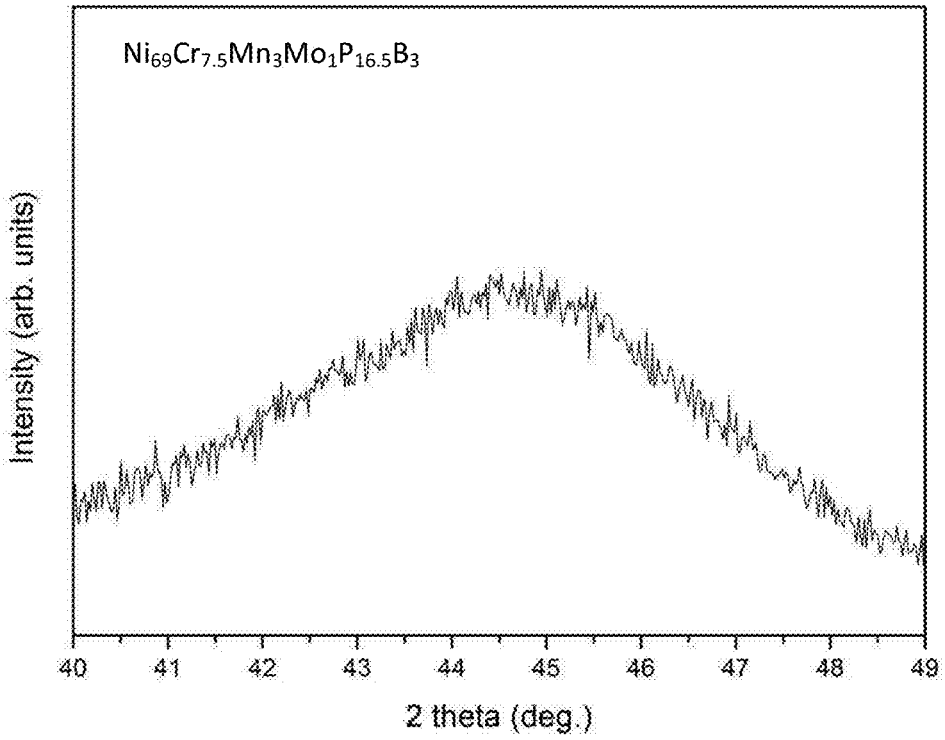
FIG. 27 provides an X-ray diffractogram verifying the amorphous structure of a 5 mm rod of example metallic glass $Ni_{69}Cr_{7.5}Mn_3Mo_1\ P_{16.5}B_3$, in accordance with embodiments of the present disclosure.

An image of a 5 mm metallic glass rod of example alloy $Ni_{69}Cr_{7.5}Mn_3Mo_1P_{16.5}B_3$ is presented in FIG. 26. An x-ray diffractogram verifying the amorphous structure of a 5 mm rod of example alloy $Ni_{69}Cr_{7.5}Mn_3Mo_1P_{16.5}B_3$ is shown in FIG. 27.

TABLE 11

Sample metallic glasses demonstrating the effect of increasing the Mo atomic concentration at the expense of Cr on the glass forming ability of the Ni—Cr—Mn—Mo—P—B alloys.

| Example | Composition | Critical Rod Diameter [mm] |
|---|---|---|
| 31 | $Ni_{69}Cr_{8.5}Mn_3P_{16.5}B_3$ | 3 |
| 55 | $Ni_{69}Cr_8Mn_3Mo_{0.5}P_{16.5}B_3$ | 3 |
| 56 | $Ni_{69}Cr_{7.5}Mn_3Mo_1P_{16.5}B_3$ | 5 |
| 57 | $Ni_{69}Cr_7Mn_3Mo_{1.5}P_{16.5}B_3$ | 3 |
| 58 | $Ni_{69}Cr_{6.5}Mn_3Mo_2P_{16.5}B_3$ | 2 |

Sample metallic glasses 31 and 59-60 showing the effect of substituting P by Si, according to the formula $Ni_{69}Cr_{8.5}Mn_3P_{16.5-x}B_3Si_x$, are listed in Table 12. As shown, Si substitution of P up to about 1% slightly degrades the glass forming ability of Ni—Cr—Mn—P—B alloys.

TABLE 12

Sample metallic glasses of the Ni—Cr—Mn—P—B—Si alloys

| Example | Composition | Critical Rod Diameter [mm] |
|---|---|---|
| 31 | $Ni_{69}Cr_{8.5}Mn_3P_{16.5}B_3$ | 3 |
| 59 | $Ni_{69}Cr_{8.5}Mn_3P_{16}B_3Si_{0.5}$ | 2 |
| 60 | $Ni_{69}Cr_{8.5}Mn_3P_{15.5}B_3Si_1$ | 2 |

Figure 28:
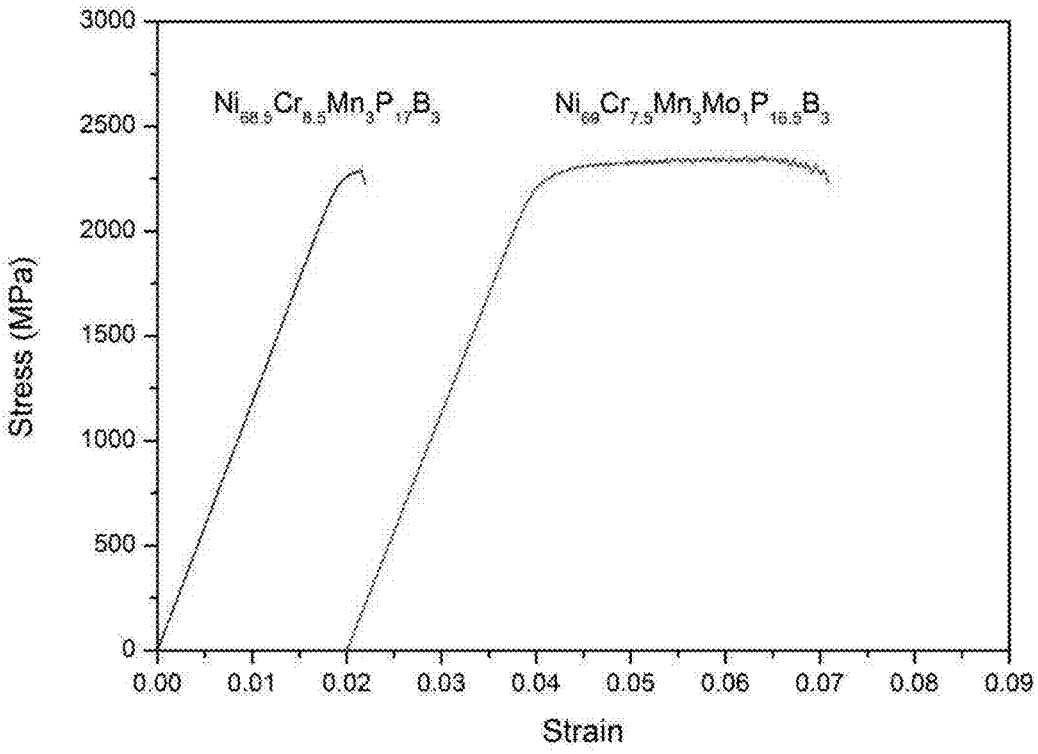
FIG. 28 provides a compressive stress-strain diagram for example metallic glasses $Ni_{68.5}Cr_{8.5}Mn_3P_{17}B_3$ and $Ni_{69}Cr_{7.5}Mn_3Mo_1P_{16.5}B_3$, in accordance with embodiments of the present disclosure.

The measured notch toughness and yield strength of sample metallic glasses $Ni_{68.5}Cr_{8.5}Mn_3P_{17}B_3$ and $Ni_{69}Cr_{7.5}Mn_3Mo_1P_{16.5}B_3$ are listed along with the critical rod diameter in Table 13. The stress-strain diagrams for sample metallic glasses $Ni_{68.5}Cr_{8.5}Mn_3P_{17}B_3$ $Ni_{69}Cr_{7.5}Mn_3Mo_1P_{16.5}B_3$ are presented in FIG. 28. A combination of good glass forming ability, high toughness, and high yield strength is demonstrated by alloy $Ni_{69}Cr_{75}Mn_3Mo_1P_{16.5}B_3$ (Alloy 28), which has 5-mm critical rod diameter, 87 MPa $m^{1/2}$ notch toughness, and 2275 MPa yield strength.

TABLE 13

Critical rod diameter, notch toughness, and yield strength of sample metallic glasses of the Ni—Cr—Mn—P—B and Ni—Cr—Mn—Mo—P—B alloys

| Example | Composition | Critical Rod Diameter [mm] | Notch Toughness [MPa $m^{1/2}$] | Yield Strength [MPa] |
|---|---|---|---|---|
| 44 | $Ni_{68.5}Cr_{8.5}Mn_3P_{17}B_3$ | 4 | 92 ± 3 | 2285 |
| 56 | $Ni_{69}Cr_{7.5}Mn_3Mo_1P_{16.5}B_3$ | 5 | 87 ± 3 | 2275 |

Figure 29:
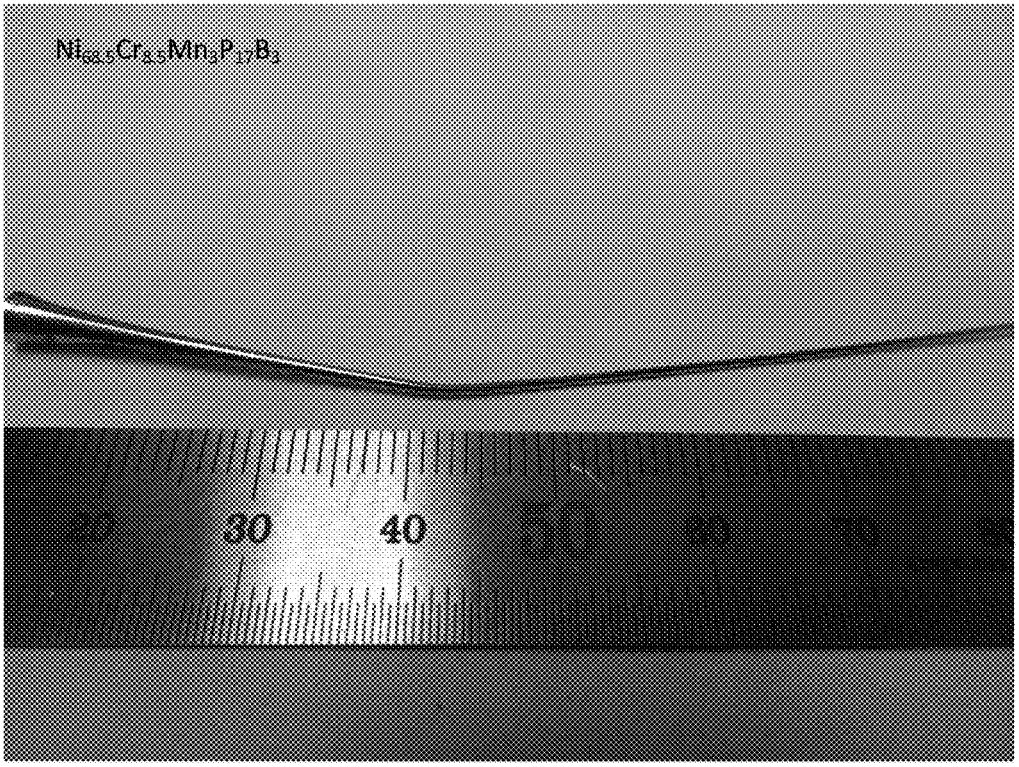
FIG. 29 provides an optical image of a plastically bent 1 mm amorphous rod of example metallic glass $Ni_{68.5}Cr_{8.5}Mn_3P_{17}B_3$, in accordance with embodiments of the present disclosure.
Figure 30:
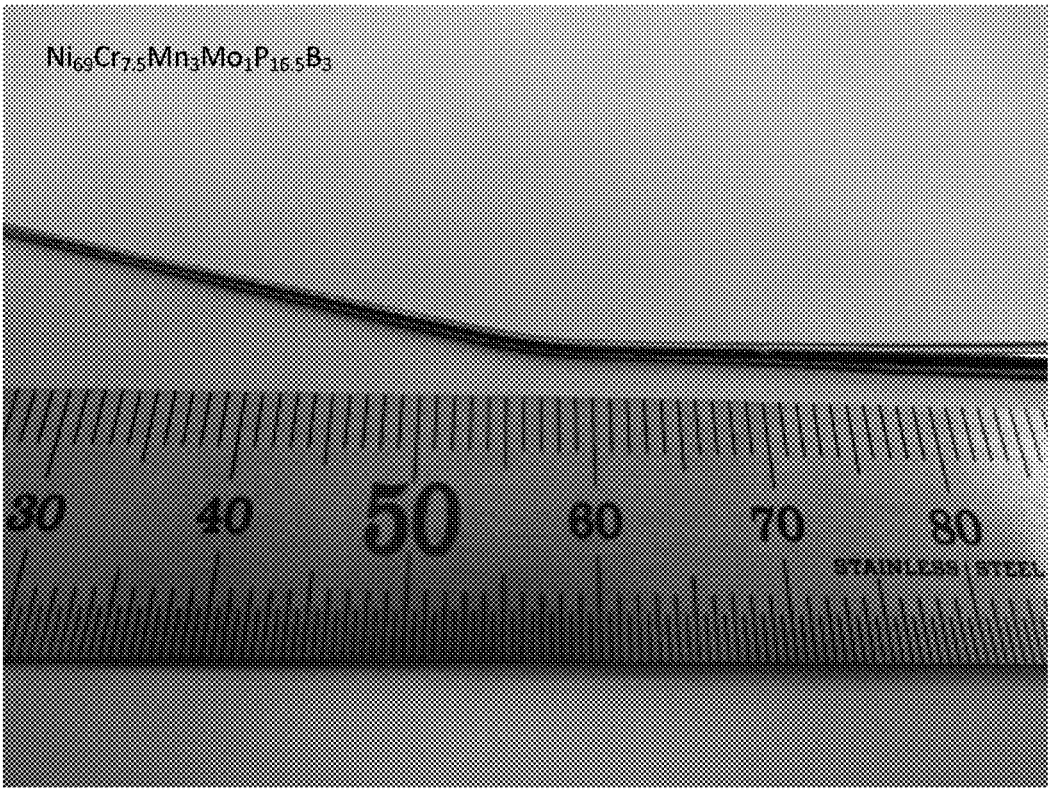
FIG. 30 provides an optical image of a plastically bent 1 mm amorphous rod of example metallic glass $Ni_{69}Cr_{7.5}Mn_3Mo_1P_{16.5}B_3$, in accordance with embodiments of the present disclosure.

The metallic glasses demonstrate bending ductility. Specifically, under an applied bending load, the metallic glasses are capable of undergoing plastic bending in the absence of fracture for diameters up to at least 1 mm. Optical images of amorphous plastically bent rods at 1-mm diameter section of example metallic glasses $Ni_{68.5}Cr_{8.5}Mn_3P_{17}B_3$ (composition 44) and $Ni_{69}Cr_{7.5}Mn_3Mo_1P_{16.5}B_3$ (composition 56) are presented in FIGS. 29 and 30, respectively.

Figure 31:
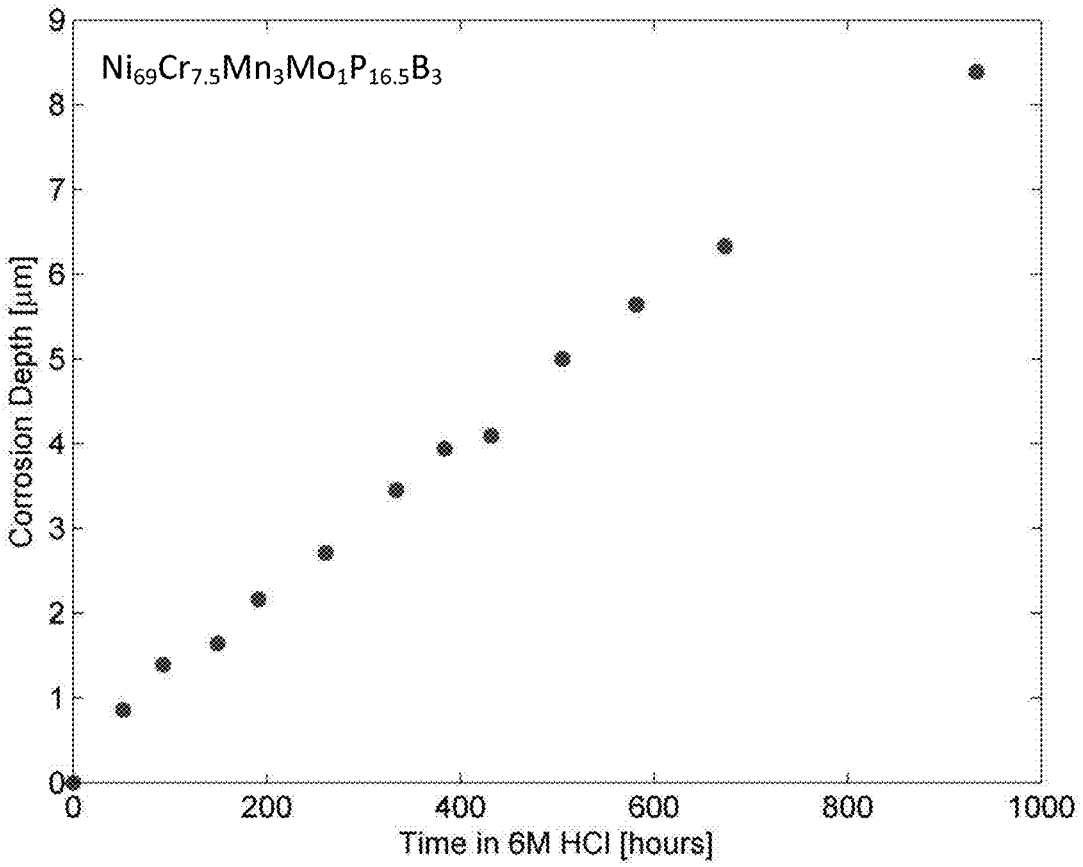
FIG. 31 provides a plot of the corrosion depth versus time in 6M HCl solution for a 3 mm metallic glass rod having composition $Ni_{69}Cr_{7.5}Mn_3Mo_1P_{16.5}B_3$, in accordance with embodiments of the present disclosure.

Lastly, the metallic glasses, Ni—Mn—Cr—Mo—P—B, also exhibit a remarkable corrosion resistance. The corrosion resistance of example metallic glass $Ni_{69}Cr_{7.5}Mn_3Mo_1P_{16.5}B_3$ (composition 56) is evaluated by immersion test in 6M HCl. A plot of the corrosion depth versus time is presented in FIG. 31. The corrosion depth at approximately 933 hours is measured to be about 8.4 micrometers. The corrosion rate is estimated to be 0.079 mm/year. The corrosion rate of all metallic glass compositions according to the current disclosure is expected to be under 1 mm/year.

Description of Methods of Processing the Sample Alloys

A method for producing the metallic glasses involves inductive melting of the appropriate amounts of elemental constituents in a quartz tube under inert atmosphere. The purity levels of the constituent elements were as follows: Ni 99.995%, Cr 99.996%, Mo 99.95%, Mn 99.9998%, Si 99.9999%, P 99.9999%, and B 99.5%. A method for producing metallic glass rods from the alloy ingots involves re-melting the ingots in quartz tubes of 0.5-mm thick walls in a furnace at 1100° C. or higher, and particularly between 1200° C. and 1400° C., under high purity argon and rapidly quenching in a room-temperature water bath. In general, amorphous articles from the alloy of the present disclosure can be produced by (1) re-melting the alloy ingots in quartz tubes of 0.5-mm thick walls, holding the melt at a temperature of about 1100° C. or higher, and particularly between 1200° C. and 1400° C., under inert atmosphere, and rapidly quenching in a liquid bath; (2) re-melting the alloy ingots, holding the melt at a temperature of about 1100° C. or higher, and particularly between 1200° C. and 1400° C., under inert atmosphere, and injecting or pouring the molten alloy into a metal mold, particularly made of copper, brass, or steel. Optionally, prior to producing an amorphous article, the alloyed ingots can be fluxed with a reducing agent by re-melting the ingots in a quartz tube under inert atmosphere, bringing the alloy melt in contact with the molten reducing agent and allowing the two melts to interact for about a time period of 1000 seconds at a temperature of about 1100° C. or higher, and subsequently water quenching.

Test Methodology for Measuring Notch Toughness

The notch toughness of sample metallic glasses was performed on 3-mm diameter rods. The rods were notched using a wire saw with a root radius of between 0.10 and 0.13 μm to a depth of approximately half the rod diameter. The notched specimens were placed on a 3-point bending fixture with span distance of 12.7 mm and carefully aligned with the notched side facing downward. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Measuring Yield Strength

Compression testing of sample metallic glasses was performed on cylindrical specimens 3 mm in diameter and 6 mm in length by applying a monotonically increasing load at constant cross-head speed of 0.001 mm/s using a screw-driven testing frame. The strain was measured using a linear variable differential transformer. The compressive yield strength was estimated using the 0.2% proof stress criterion.

Test Methodology for Measuring Corrosion Resistance

The corrosion resistance of sample metallic glasses was evaluated by immersion tests in hydrochloric acid (HCl). A rod of metallic glass sample with initial diameter of 2.97 mm, and a length of 14.77 mm was immersed in a bath of 6M HCl at room temperature. The density of the metallic glass rod was measured using the Archimedes method to be 7.751 g/cc. The corrosion depth at various stages during the immersion was estimated by measuring the mass change with an accuracy of ±0.01 mg. The corrosion rate was estimated assuming linear kinetics.

Having described several embodiments, it will be recognized by those skilled in the art that various modifications, alternative constructions, and equivalents may be used without departing from the spirit of the disclosure. Those skilled in the art will appreciate that the presently disclosed embodiments teach by way of example and not by limitation. Therefore, the matter contained in the above description or shown in the accompanying drawings should be interpreted as illustrative and not in a limiting sense. Additionally, a number of well-known processes and elements have not been described in order to avoid unnecessarily obscuring the disclosure. The following claims are intended to cover all generic and specific features described herein, as well as all statements of the scope of the present method and system, which, as a matter of language, might be said to fall therebetween.

What is claimed:

1. An alloy comprising at least Ni, Mn, X, P and B represented by the following formula (subscripts denote atomic percentages):

$$Ni_{(100-a-b-c)}Mn_aX_bP_{c-d}B_d \quad (1)$$

where:

a is between 0.5 and 10, b is up to 15, c is between 14 and 24, d is between 1 and 8, and wherein X is Cr and/or Mo, the balance is Ni, and the alloy is capable of forming a metallic glass, wherein the alloy has a critical rod diameter is at least 1 mm.

2. The alloy according to claim 1, wherein b is at least 1, and wherein the alloy also comprises at least one of Nb or Ta at a combined atomic concentration of less than 1 percent.

3. The alloy according to claim 1, wherein b is 0, and wherein the alloy also comprises at least one of Nb or Ta at a combined atomic concentration of less than 0.5 percent.

4. The alloy according to claim 1, wherein up to 1 atomic percent of P is substituted by Si.

5. The alloy according to claim 1, wherein Ni is substituted in accordance with at least one of the following: up to 50 atomic percent of Ni is substituted by Co, up to 30 atomic percent of Ni is substituted by Fe, or up to 10 atomic percent of Ni is substituted by Cu.

6. A metallic glass formed of the alloy according to claim 1.

7. The alloy according to claim 1, wherein b=0, a is at least 2 and up to 9.5, c is between 16.5 and 21.5, and d is between 1 and 6.5.

8. An alloy according to claim 7, wherein a is between 3 and 8 and the critical rod diameter is at least 2 mm.

9. An alloy according to claim 7, wherein a is between 6 and 7.5 and the critical rod diameter is at least 3 mm.

10. An alloy according to claim 7, wherein c is between 17.25 and 20.75 and the critical rod diameter is at least 2 mm.

11. An alloy according to claim 7, wherein c is between 18.5 and 20.25 and the critical rod diameter is at least 3 mm.

12. An alloy according to claim 7, wherein d is between 1.75 and 5.75 and the critical rod diameter is at least 2 mm.

13. An alloy according to claim 7, wherein d is between 2.5 and 3.75 and the critical rod diameter is at least 3 mm.

14. An alloy represented by the formula (subscripts denote atomic percentages):

$$Ni_{(100-a-b1-b2-c-d)}Mn_aCr_{b1}Mo_{b2}P_cB_d \quad (2)$$

where:

a is between 1 and 5, b1 is between 4 and 11, b2 is up to 3, c is between 15 and 19, and d is between 1 and 5, wherein the alloy has a critical rod diameter is at least 2 mm.

15. An alloy according to claim 14, wherein a is between 2.25 and 3.75, b1 is between 5 and 10, b2 is up to 2, c is between 15.75 to 18, d is between 1.5 and 4.5, and the critical rod diameter is at least 2 mm.

16. An alloy according to claim 14, wherein a is between 2.5 and 3.5, b1 is between 6 and 9, b2 is up to 1.5, c is between 16 to 17.75, d is between 2.25 and 3.75, and the critical rod diameter is at least 3 mm.

17. An alloy according to claim 14, wherein a is between 2.75 and 3.25, b1 is between 6 and 8, b2 is between 0.75 and 1.25, c is between 16 to 17.25, d is between 2.5 and 3.5, and the critical rod diameter is at least 4 mm.

18. An alloy according to claim 14, wherein the sum of c and d is between 18.5 and 20.5.

19. A metallic glass formed of the alloy according to claim 14.

* * * * *